US005350882A

United States Patent [19]

Koguchi et al.

[11] Patent Number: 5,350,882

[45] Date of Patent: Sep. 27, 1994

[54] AUTOMATIC PERFORMANCE APPARATUS WITH OPERATED ROTATION MEANS FOR TEMPO CONTROL

[75] Inventors: Satoru Koguchi, Tokyo; Yoshiki Negoro, Ome, both of Japan

[73] Assignee: Casio Computer Co., Ltd., Tokyo, Japan

[21] Appl. No.: 984,103

[22] Filed: Dec. 1, 1992

[30] Foreign Application Priority Data

| | | | |
|---|---|---|---|
| Dec. 4, 1991 | [JP] | Japan | 3-320327 |
| Dec. 4, 1991 | [JP] | Japan | 3-320328 |
| Dec. 10, 1991 | [JP] | Japan | 3-350092 |

[51] Int. Cl.[5] ..... G10H 7/00

[52] U.S. Cl. ..... 84/636; 84/612; 84/644; 84/652

[58] Field of Search ..... 84/612, 636, 644, 652, 84/668, 670

[56] References Cited

U.S. PATENT DOCUMENTS

| | | | |
|---|---|---|---|
| 4,813,327 | 3/1989 | Abe . | |
| 5,241,125 | 8/1993 | Miyamoto | 84/609 |
| 5,245,663 | 9/1993 | Green | 84/603 X |
| 5,266,736 | 11/1993 | Saito | 84/612 |
| 5,278,348 | 1/1994 | Eitaki et al. | 84/636 |
| 5,286,909 | 2/1994 | Shibukawa | 84/612 X |

FOREIGN PATENT DOCUMENTS

| | | |
|---|---|---|
| 59-125787 | 7/1984 | Japan . |
| 60-2990 | 1/1985 | Japan . |
| 61-46993 | 3/1986 | Japan . |
| 2-244094 | 9/1990 | Japan . |

*Primary Examiner*—William M. Shoop, Jr.
*Assistant Examiner*—Jeffrey W. Donels
*Attorney, Agent, or Firm*—Frishauf, Holtz, Goodman & Woodward

[57] ABSTRACT

An automatic performance apparatus which easily changes the tempo and direction of automatic performance of a musical instrument, for example, to a rhythm of a rap music such that a disc jockey operates a scratch disc. Clock frequency SQCK of sequence counter 202 is changed in accordance with the speed and quantity of rotation of disc 102 and ball 1101 rotated with user's fingers, so that the timing of reading event data and event time data out of sequencer memory 206 is controlled and the tempo of the automatic performance is changed. When the user changes the rotational direction of disc 102, counter 202 performs a decrementing operation in accordance with a rotational direction signal output from rotational direction detector 110, thereby giving a reverse automatic performance. At the start of the automatic performance, disc 102 starts to rotate at a predetermined rotational speed in accordance with tempo data read out of sequencer memory 206 to thereby determine the initial tempo of the automatic performance (FIG. 1).

13 Claims, 22 Drawing Sheets

| ADDRESS | |
|---|---|
| 0 | 0 |
| 1 | NOTE-ON,C2 |
| 2 | 12 |
| 3 | NOTE-OFF,C2 |
| 4 | 24 |
| 5 | NOTE-ON,E2 |
| 6 | 32 |
| 7 | NOTE-OFF,E2 |
| 8 | 48 |
| 9 | NOTE-ON,G2 |
| 10 | 60 |
| 11 | NOTE-OFF,G2 |
| 12 | 68 |
| ⋮ | ⋮ |
| N-5 | NOTE-OFF,F3 |
| N-4 | 9504 |
| N-3 | NOTE-ON,D3 |
| N-2 | 9528 |
| N-1 | NOTE-OFF,D3 |
| N | 9528 |
| N+1 | TEMPO DATA |

FIG.3

| ADDRESS | |
|---|---|
| 0 | 0 |
| 1 | NOTE-ON,C2 |
| 2 | 6 |
| 3 | NOTE-ON,E2 |
| 4 | 12 |
| 5 | NOTE-OFF,C2 |
| 6 | 15 |
| 7 | NOTE-ON,G2 |
| 8 | 18 |
| 9 | NOTE-OFF,E2 |
| 10 | 24 |
| 11 | NOTE-OFF,G2 |
| 12 | 36 |
| ⋮ | ⋮ |
| N-5 | NOTE-ON,F3 |
| N-4 | 8640 |
| N-3 | NOTE-OFF,G3 |
| N-2 | 8652 |
| N-1 | NOTE-OFF,F3 |
| N | 8652 |
| N+1 | TEMPO DATA |

FIG.4

AUTOMATIC PERFORMANCE APPARATUS WITH OPERATED ROTATION MEANS FOR TEMPO CONTROL

BACKGROUND OF THE INVENTION

1. Field of the Invention

The present invention relates to techniques for control of a read-out state of data on automatic performance.

2. Description of the Related Art

An automatic performance apparatus sequentially reads out data on automatic performance stored in a memory, and delivers this data to a sound source circuit to thereby reproduce a musical tone automatically.

In this case, the reproduction tempo of the automatic performance is generally determined by a fixed tempo clock. General techniques for changing the reproduction tempo use an up switch and a down switch such as those disclosed in published unexamined Japanese patent application Hei 2-244094 (published Sep. 28, 1990). The user operates the up switch and down switch to change the frequency of the tempo clock and hence the reproduction tempo. However, depression of a switch such as that technique is not easy for the user to use because the user must depress the switches many times/continue to depress them to gradually change the frequency of the tempo clock in order to arrive at a desired reproduction tempo.

A "disk jockey" who is in charge of control of record reproduction in a "discotic" manner uses an operating method "scratch" such as changes the rotational speed of the record disk by depressing the rotating record disk with his fingers to change the reproduction tone of the record.

When such operation technique "scratch" is applied to the automatic performance apparatus, the use of the up switch/down switch would not achieve a very rapid tempo adjustment.

CASIO Computer Co., Ltd. to which this invention is expected to be assigned has manufactured and sold since Jun. 20, 1991 articles which produce a sound in accordance with the rotation of a "scratch disk" attached to an electronic musical instrument under the trade name "RAP-1 ".

This article has a first and a second switch below the scratch disk. By rotating the scratch disk clockwise through a predetermined angle to render the first switch conductive while it is rotated counterclockwise through a predetermined angle to render the second switch conductive. When the first and second switches are rendered conductive, sounds with different timbre scratch effects are produced. As just described above, the scratch disk of the conventional electronic musical instrument only rotates the rotating disk through a predetermined angle to produce a special effect sound in place of depression of a push button.

Therefore, even if the scratch disk techniques for the conventional electronic musical instruments are applied to an automatic performance apparatus, the device still has the same drawbacks as the conventional up switch/-down switch. Thus, the development of a scratch disk suitable for automatic performance has been desired.

SUMMARY OF THE INVENTION

It is an object of the present invention to develop techniques for a scratch disk suitable for an automatic performance apparatus, and to provide an automatic performance apparatus which controls the tempo of automatic performance of and the direction of reproduction of the records by causing the player to rotate a disk.

In order to achieve the above object, according to the present invention, there is provided an automatic performance apparatus comprising:

operated rotation means operated by the user for rotating purposes;

operated state detecting means for detecting whether the user is operating the operated rotation means;

rotational speed detecting means for detecting the rotational speed of the operated rotation means;

clock output means for outputting a clock signal having a frequency corresponding to the rotational speed detected by the rotational speed detecting means;

automatic performance data storage means for storing data on automatic performance; and automatic performance control means for giving an automatic performance while controlling a timing at which the data on the automatic performance is read out in units of a time corresponding to the frequency of the clock signal.

By this structure, the user can easily and rapidly operate and set the tempo of automatic performance by an intelligible operation of rotating the rotation means.

According to a second aspect of the present invention, there is provided an automatic performance apparatus comprising:

operated rotation means operated by the user;

operated state detecting means for detecting whether the user is operating the operated rotation means, rotational speed detecting means for detecting the rotational speed of the rotation means;

rotational direction detecting means for detecting the rotational direction of the rotation means;

drive means for driving said rotation means such that when the result of the detection by the operated state detecting means becomes affirmative most recently, the rotation means has the rotational speed which the rotational speed detecting means has detected and the rotational direction which the rotational direction detecting means has detected;

clock output means for outputting a clock signal having a frequency corresponding to the rotational speed which the rotational speed detecting means has detected;

rotational direction signal output means for outputting a rotational direction signal corresponding to the rotational direction of said rotation means which the rotational direction detecting means has detected;

automatic performance data storage means for sequentially storing at successive addresses sets of event data and time data for control of a timing of reading out the event data for automatic performance; and automatic performance control means for controlling on the basis of the rotational direction signal the direction of designating an address at which each set of event data and time data is read out in the automatic performance data storage means, for reading that event data while controlling the timing of reading that set of event data and time data by determining the time data in units of a time corresponding to the frequency of the clock signal, and for causing a musical instrument to give an automatic performance on the basis of that event data.

In the second aspect of the present invention, when the operated state of the automatic performance apparatus is to be controlled, the user rotates the rotation means finely to freely control the tempo and direction of the automatic performance, for example, to the rhythm of a rap music as if the disk jockey operated a scratch disk.

In this case, the user can sensuously grip the tempo and direction of automatic performance set by himself in the form of rotation of the rotating means.

Especially, at the start of the automatic performance, the rotation means starts to rotate at a predetermined rotational speed, so that automatic performance can start at a predetermined tempo. By determining the initial rotational speed on the basis of data on the tempo stored beforehand in the automatic performance data storage means, the initial tempo of the automatic performance can be determined beforehand.

According to the third aspect of the present invention, there is provided an automatic performance apparatus comprising:

operated means operated by the user;

an operation change quantity detecting means for detecting an operation change quantity of the operated means;

accumulating means having a predetermined initial value as an accumulated value when the accumulating means is used for accumulating the operation change quantity;

clock output means for outputting a clock signal having a frequency corresponding to an absolute value of an accumulated value output from the accumulating means;

direction signal output means for outputting as a direction signal a signal indicative of a sign of the accumulated value output from the accumulating means;

display means including a plurality of light emitting elements for causing same to sequentially emit light at a rate corresponding to the absolute value of the accumulated value output from the accumulating means in a direction corresponding to the sign of the accumulated value;

automatic performance data storage means for sequentially storing at successive addresses sets of event data and time data for control of a timing of reading out the event data for automatic performance; and automatic performance control means for controlling on the basis of the rotational direction signal the direction of designating an address at which each set of event data and time data is read out in the automatic performance data storage means, for reading that event data while controlling the timing of reading that set of event data and time data by determining the time data in units of a time corresponding to the frequency of the clock signal, and for causing a musical instrument to give an automatic performance on the basis of that event data.

In the third aspect of the present invention, when the operating state of the automatic performance apparatus is to be controlled, the user operates the operated means finely to control the tempo and direction of the automatic performance as in the second aspect of the present invention on the basis of a clock signal having a frequency synchronous with the magnitude of an accumulated value corresponding to a quantity of operation of the operated means and a signal indicative of the direction of operation of the operated means.

In this case, the user can intuitively grip the current controlled accumulated value in the form of movement of the light emission state in the display means. Since the device has no mechanically driven parts, its reliability is high and its cost is low. Thus, miniaturization of the device is achieved.

Especially, at the start of automatic performance, a predetermined initial value is set in the accumulating means, so that automatic performance can start at a predetermined tempo. By determining the initial value in the accumulating means on the basis of data on the tempo stored beforehand in the automatic performance data storage means, the initial tempo of the automatic performance can beforehand be determined as in the second aspect of the present invention.

BRIEF DESCRIPTION OF THE DRAWINGS

FIG. 3 is a diagram indicative of an example of the storage contents of a SQ (Sequencer) memory (in the case of a monophony).

FIG. 4 is a diagram indicative of an example of the storage contents of a SQ memory (in the case of a polyphony).

FIG. 5(*b*) is an operation flowchart of the SQ controller (part).

DESCRIPTION OF THE PREFERRED EMBODIMENTS

An embodiment of the present invention will be described below with reference to the drawings. The automatic performance apparatus of the embodiment is composed of a tempo setting unit 100 for setting the tempo of an automatic performance and a sequencer 200 which gives an automatic performance on the basis of the tempo set by the tempo setting unit.

Three embodiments (100A, 100B and 100C) of the tempo setting unit will be shown and described below.

First Embodiment Composed of Tempo Setting Unit 100A and Sequencer 200

First, a first embodiment composed of tempo setting unit 100A and sequencer 200 will be described with reference to FIGS. 1-7.

Structure of Tempo Setting Unit 100A

Figure 1:
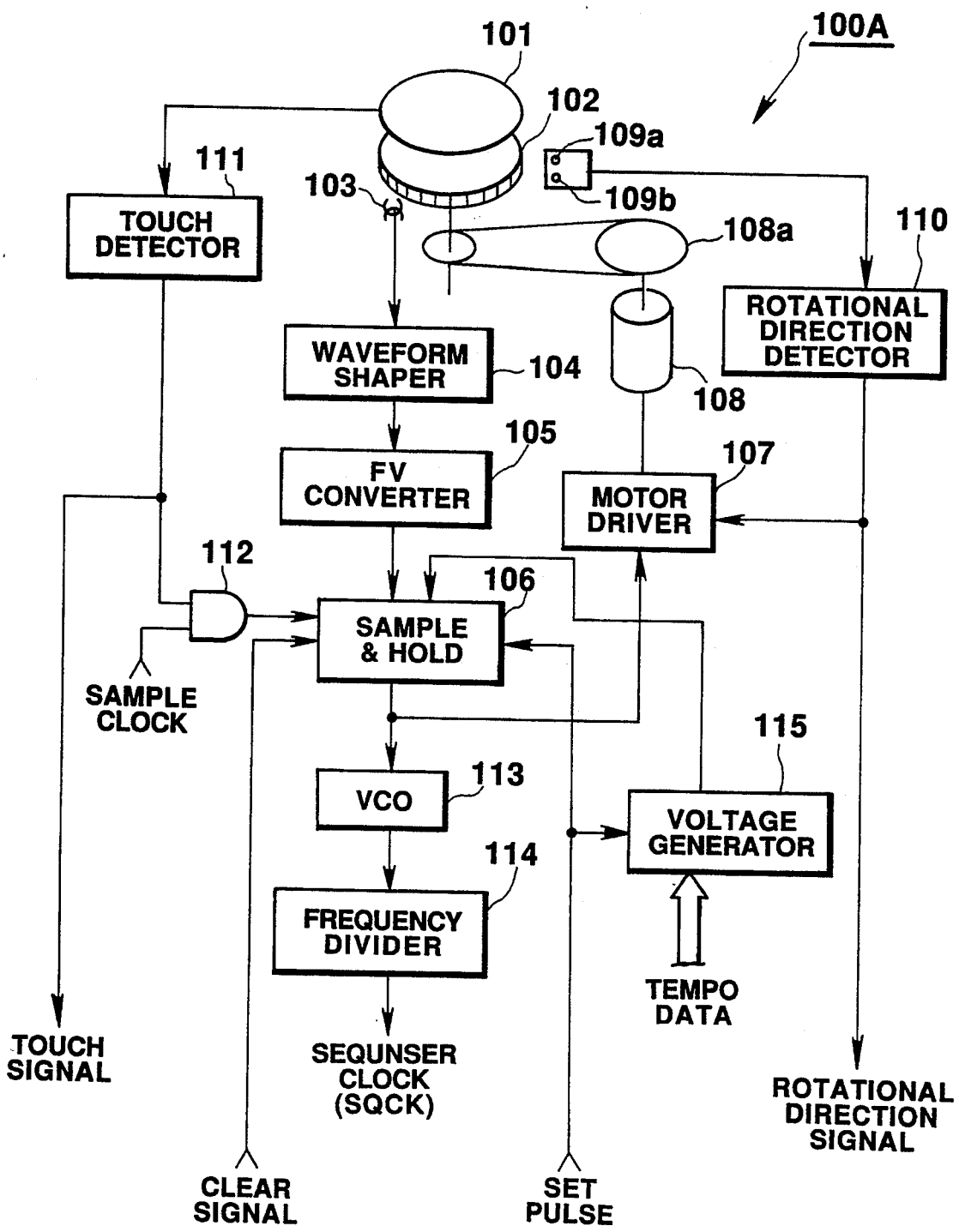
FIG. 1 shows the overall structure of a tempo setting unit 100A (first embodiment).

FIG. 1 shows the overall structure of tempo setting unit 100A.

In FIG. 1, first, when the user switches on a start switch 208 of sequencer 200 (FIG. 2), a clear signal output from SQ (sequencer) controller 203 (FIG. 2) clears the contents of sample and hold circuit 106. SQ controller 203 reads out data on the appropriate one of tempos stored in SQ memory 206 (FIG. 2) and delivers it to voltage generator 115. Simultaneously, SQ controller 203 outputs a set pulse to voltage generator 115 and sample and hold circuit 106.

As a result, voltage generator 115 generates a voltage corresponding to the tempo data and this voltage is sampled and held by sample and hold circuit 106 in accordance with the set pulse. This voltage is input to motor driver 107 and also to VCO (Voltage Controlled Oscillator) 113.

Motor driver 107 starts to drive motor 108 at a rotational speed corresponding to the voltage. The rotation of motor 108 is transmitted by a pulley-belt mechanism 108 to a disk 102. In this way, disk 102 which has been stationary so far starts to be rotated by the voltage on the basis of the tempo data set as an initial value.

VCO 113 oscillates at a frequency corresponding to that voltage. The oscillating output from the oscillator is divided by frequency divider 114 at a predetermined ratio to produce a sequencer clock SQCK. In this way, a sequencer clock SQCK having a frequency corresponding to the initial rotational speed of disk 102 is obtained. In the sequencer 200 to be described below in more detail, automatic performance starts at a tempo corresponding to the frequency of sequencer clock SQCK.

Touch panel 101 for touch detection including a touch sensor (not shown) is provided above disk 102. The touch sensor senses, for example, a static capacity. A touch detector 111 detects a change in the static capacity occurring when a human body touches touch panel 101 and outputs a corresponding touch signal. When the user manually touches or rotates such disk 102 after automatic performance has started, the touch sensor in touch panel 101 senses the user's fingers touch on disk 102, and touch detector 111 outputs a touch signal indicative of such fact to AND gate 112 while the user is touching the disk. Each time the AND gate receives a sample clock from a clock generator (not shown), the touch signal is input as a sample and hold signal to sample and hold circuit 106.

Disk 102 has a lower surface coated with a magnetic material on which a binary signal having a predetermined frequency is magnetically recorded as in an LP record turntable. By detecting the binary signal with reproduction head 103, a binary signal having a frequency proportional directly to the rotational speed of disk 102 is detected. This signal detector may have an arrangement in which a hall device which detects respective small magnets arranged along the periphery of a circle on a lower surface of disk 102 to produce a binary signal as in an FG (Frequency Generator) provided in a servo motor. This binary signal is detected as a pulse signal after its waveform is shaped by waveform shaper 104, and then input to FV (frequency-voltage) converter 105 where it is converted to a voltage corresponding to a frequency which, in turn, corresponds to the rotational speed.

In this way, while the user is rotating disk 102, sample and hold circuit 106 sequentially samples and holds the output voltage from FV converter 104. When the user releases disk 102 from his fingers, a voltage corresponding to the rotational speed of disk 102 at that time is sampled and held and input to motor driver 107. As described above, motor driver 107 drives motor 108 at the rotational speed corresponding to the voltage, and the rotation of the motor is transmitted by pulley-belt mechanism **108*a* to disk 102**.

In this way, even after the user has released disk 102 from his fingers, the rotational speed of the disk 102 at that instant is maintained. When the user stops the rotation of disk 102 by depressing it manually, the output of FV converter 105 becomes "0" and the voltage whose data is held in sample and hold circuit 106 becomes "0". Thus, motor driver 107 outputs no driving voltage to motor 108, so that disk 102 loses its rotational force. As a result, when the user stops the rotation of the disk 102 and then releases it, disk 102 stops its rotation.

In order to detect the direction of rotation of disk 102, disk 102 has two kinds of bars different in width and similar to bar codes and arranged around the outer periphery thereof. The bar arrangement is irradiated with light from photodiode **109*a* and its reflected light is read out by photosensor 109*b***. Assume that a wider bar represents a numerical value of 1 while a narrower bar represents a numerical value of 0. If a signal read out of the bar arrangement in the forward rotation of the disk is a repeated pattern of binary data of 9 bits as follows:

100010010, the signal read out of the bar arrangement in the reverse rotation is given by

010010001 which is a repeated pattern of binary data of 9 bits arranged in a order reverse to that in the forward rotation.

Rotational direction detector 110 recognizes the difference between the signal pattern read out from disk 102 through photosensor **109*b* to determine the forward or backward rotation of disk 102**.

Although further description of the detailed structure of rotational direction detector 110 is omitted, it performs the following operations, for example.

In rotational direction detector 110, first, the output of photosensor 109b is shaped and converted to a train of digital values, which is then sequentially input to a 9-bit shift register (not shown) provided in the detector 110.

Provided in rotational direction detector 110 is a pair of latches setting therein two kinds of patterns and, more particularly, digital values constituting a basic pattern of "1-0-0-0-1-0-0-1-0" corresponding to the forward rotation and the digital values constituting a basic pattern of "0-1-0-0-1-0-0-0-1" corresponding to the reverse rotation.

The 9-bit data output from the shift register is compared to the train of 9-bit digital values set in each latch. The forward/reverse direction of rotation of disk 102 is detected by determining whether the contents of any of the latches coincides with the output from the shift register.

The detection signal indicative of the rotational direction of disk 102 (rotational direction signal) is used to determine whether data stored on SQ memory 206 (FIG. 2), to be described later in more detail, is to be read out in the direction in which the address value increases or otherwise in the direction in which the address value decreases.

The output voltage from sample and hold circuit 106 is delivered to VCO 113, as described above. VCO 113 oscillates at a frequency corresponding to that voltage and its oscillating output is divided at a predetermined ratio by frequency divider 114 to produce a sequencer clock SQCK.

In this way, sequencer clock SQCK having a frequency corresponding to the rotational speed of disk 102 rotated by the user is obtained to thereby give an automatic performance at a tempo corresponding to the frequency of sequencer clock SQCK in sequencer 200, to be described next in more detail.

Structure of Sequencer 200

Figure 2:
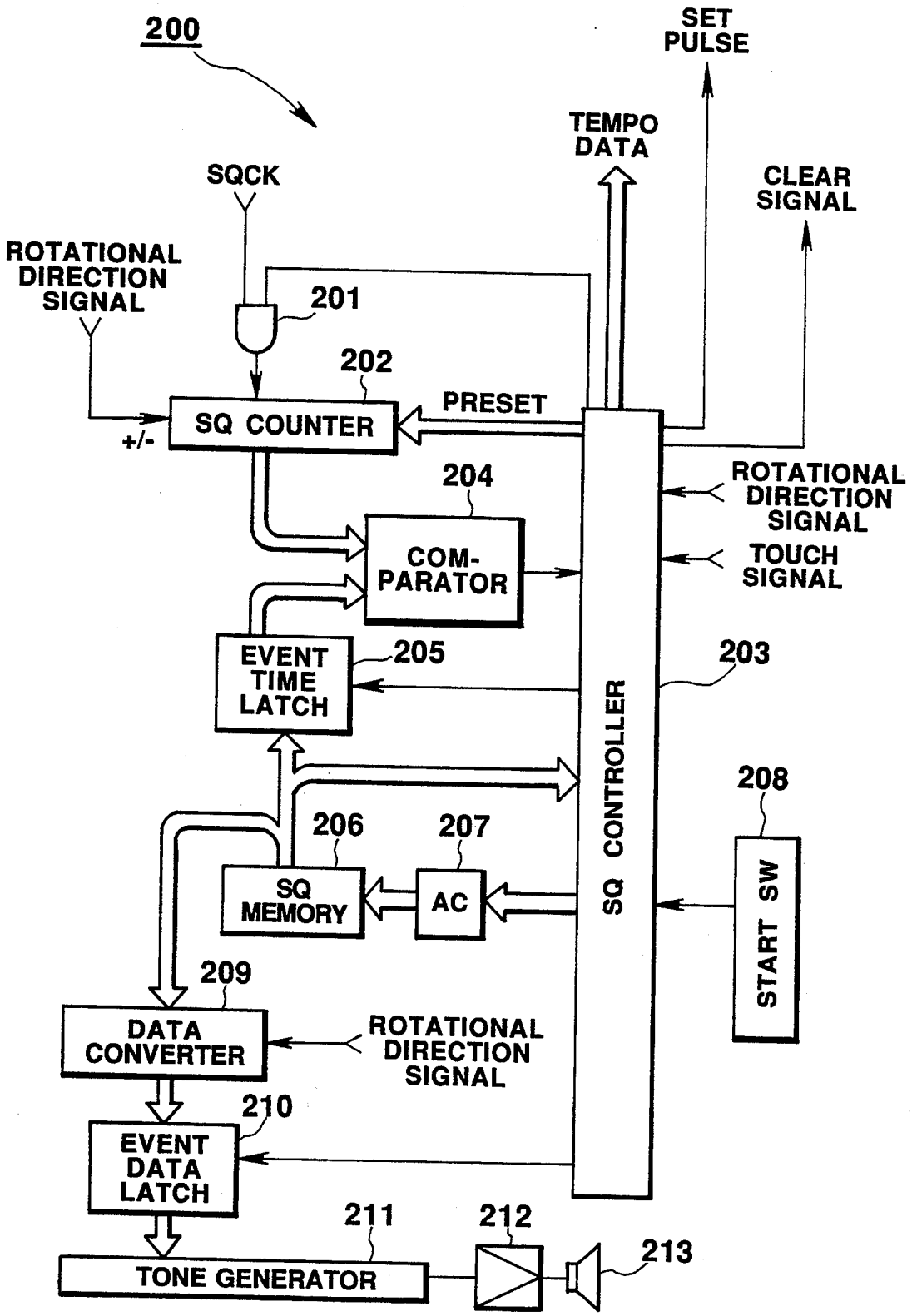
FIG. 2 shows the overall structure of a sequencer 200.

Sequencer 200 will be described below. FIG. 2 shows the overall structure of sequencer 200. In FIG. 2, sequencer clock SQCK output from frequency divider 114 of FIG. 1 is input to SQ counter 202 through AND gate 201. In addition, a rotational direction signal from rotational direction detector 110 is also input to SQ controller 203, like a touch signal from touch detector 111 of FIG. 1.

SQ memory 206 stores sets of event data for an automatic performance, and event time data, which determines the timing at which an automatic performance corresponding to the event data is given, in the order of event time data-event data and stores data on the starting tempo of the automatic performance at the last address.

FIG. 3 conceptually illustrates the contents of data on automatic performance stored in SQ memory 206 when an automatic performance is given in a monophony in musical tone generator 211 of FIG. 2. Event time data is stored at even addresses 0, 2, 4, . . . , N−2. This event time shows a time when an event is executed whose data is stored at an odd address next to the address where that event time data is stored, as an accumulated value of sequencer clocks SQCK since the start of the automatic performance. Therefore, if the frequency of this clock SQCK changes, the absolute lapse time also changes. In the present embodiment, the user changes the rotational speed of disk 102 to thereby change the frequency of sequencer clock SQCK and hence the automatic performance speed freely. If an automatic performance is given in a monophony, event data indicative of the note-off for a note number is stored necessarily at an address preceding by two addresses from the address where event data indicative of the note-on for that note number is stored. Data on the head event time in SQ memory 206 corresponds to a time elapsing from the starting point of automatic performance and, in the present embodiment, is "0". Simultaneously with the start of the automatic performance, an event corresponding to the event data stored at address 1 is performed.

FIG. 4 conceptually illustrates the contents of data on an automatic performance stored in SQ memory 206 and given in a polyphony in musical tone generator 211 of FIG. 2. The points different from those in the FIG. 3 monophonic case are that event data indicative of the note-off for a note number is not necessarily stored at an address preceding by two addresses from an address where event data indicative of the note-on for that note number is stored, but event data indicative of the note-on or note-off for another note number may be stored at that address. It is to be noted that event data indicative of the note-off for a note number is necessarily stored at an address subsequent to an address where event data indicative of the note-on for that note number is stored.

As shown in FIG. 3 or 4, SQ memory 206 stores N/2 sets of event time data and event data at its addresses 0 to N−1. Event time data equal to the event time data at address N−2 is stored at the last address but one N in order to obtain compatibility with the operation of the device on the basis of the operation flowchart of FIGS. 5 and 6, to be described later in more detail. Data on the tempo for setting the starting tempo of the automatic performance is stored at the last address N+1.

The tempo, event time and event data stored in SQ memory 206 are read out of SQ memory 206 in accordance with designation of an address signal output from AC (Address Counter) 207. The tempo data is output to SQ controller 203. The event time data is latched by event time latch 205 while the event data is latched through data converter 209 by event data latch 210.

As will be described later in more detail, at the start of the automatic performance, SQ controller 203 first reads out the tempo data stored at the last address in SQ memory 206, outputs a clear signal to sample and hold circuit 106 of FIG. 1, delivers the tempo data to voltage generator 115 of FIG. 1, and outputs a set pulse to sample and hold circuit 106 and voltage generator 115.

When the rotational direction signal input to data converter 209 indicates a forward direction, data converter 209 causes the received event data to pass intactly therethrough while when it indicates a reverse direction, data converter 209 converts a note-on code to a note-off code and a note-off code to a note-on code in the received event data and outputs the converted code.

In order to count the time of the event of automatic performance, SQ counter 202 increments or decrements by one the current count value on the basis of a signal indicative of the rotational direction of disk 102 each time it receives sequencer clock SQCK, and outputs the resulting count to comparator 204.

Comparator 204 compares the value of the event time output from event time latch 205 with the output count value from SQ counter 202 and outputs a coincidence signal when both the values coincide.

SQ controller 203 increments the count of AC 207 on the basis of the coincidence signal and outputs a latch clock to event data latch 210 and event time latch 205.

As a result, event data latch 210 latches the next event data on the basis of an address signal from AC 207, musical tone generator 211 produces or mutes a tone signal having a note number based on that data, and speaker 213 produces a musical tone through amplifier 212. Simultaneously, event time latch 205 latches the next event time on the basis of which comparator 204 compares the next timing.

The Overall Operation of the Embodiment Composed of Tempo Setting Unit 100A and Sequencer 200

The overall operation of the embodiment composed of tempo setting unit 100A of FIG. 1 and sequencer 200 of FIG. 2 will be described. This description refers to FIG. 1 or 2 as long as it is noted otherwise.

Figure 5A:
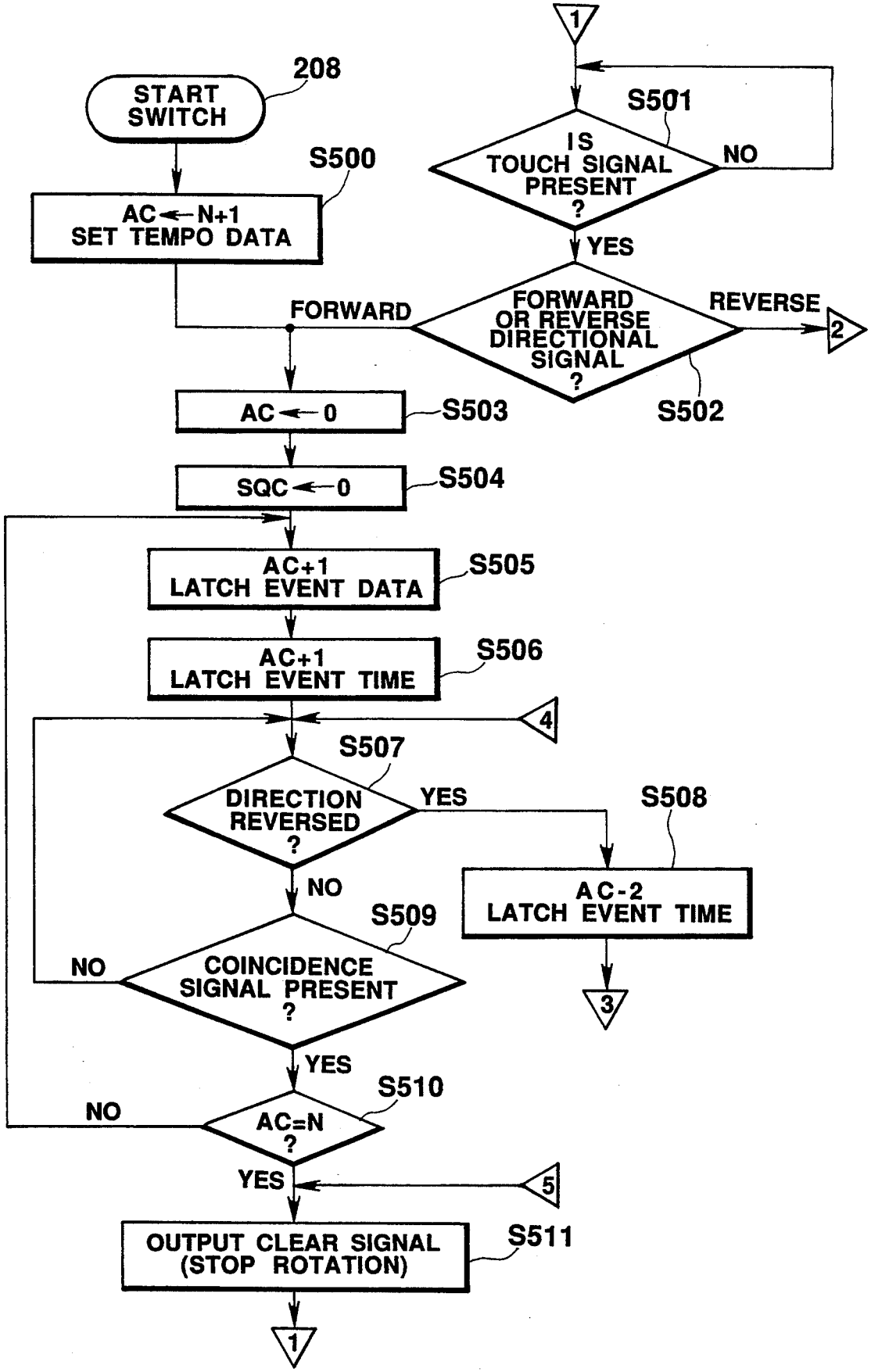
FIG. 5(*a*) is an operation flowchart for a SQ controller (part).
Figure 5:
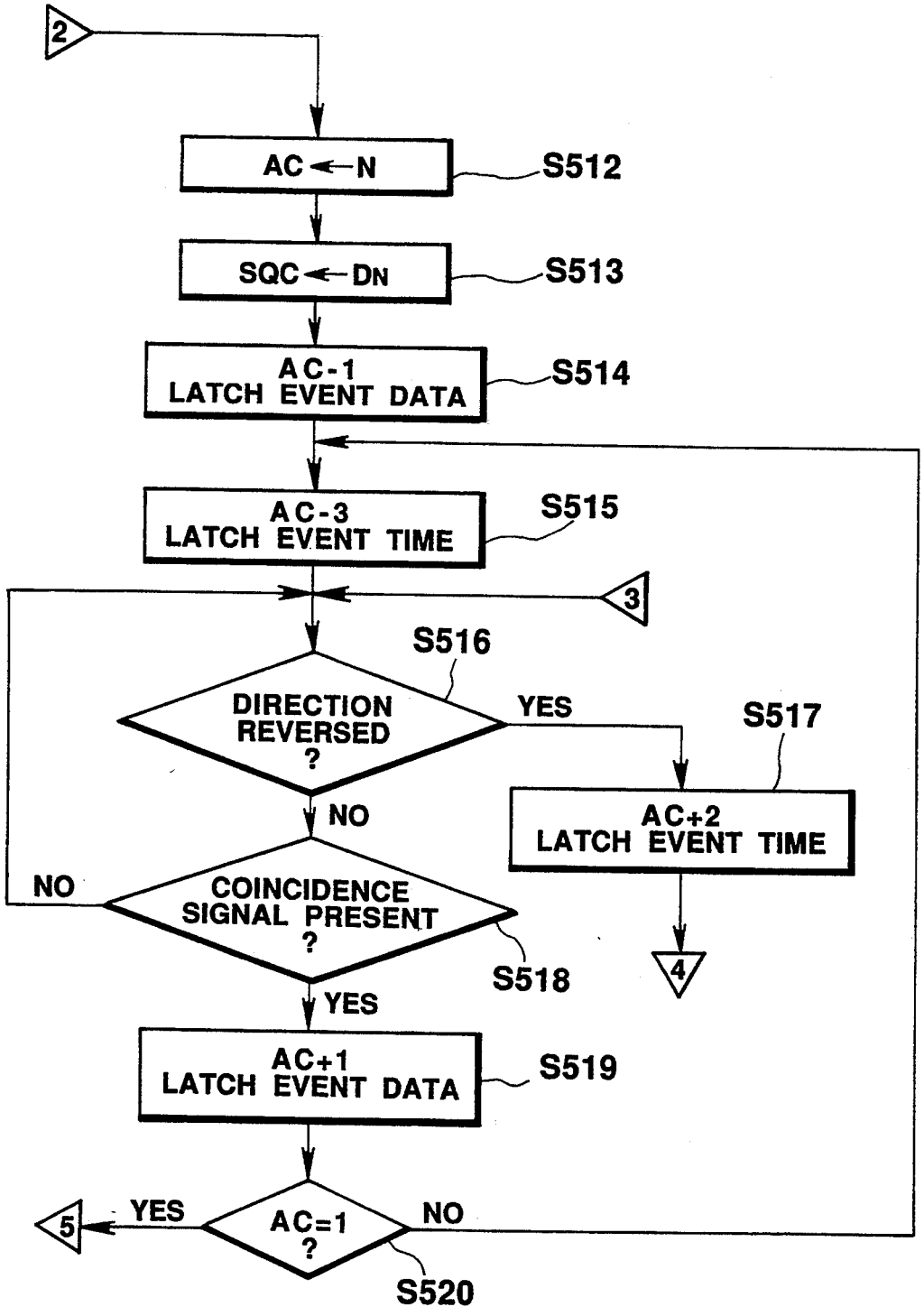

FIGS. 5(*a*) and (*b*) are the operation flowchart of SQ controller 203.

In FIG. 5(*a*), first, when start switch 208 is switched on, SQ controller 203 turns on AND gate 201 to thereby enable automatic performance by sequencer 200.

At the beginning, a value N+1 indicative of the last address in SQ memory 206 is set in AC (Address Counter) 207, and the initial value of tempo data is read out of SQ memory 206. Subsequently, SQ controller 203 outputs the tempo data to voltage generator 115, and a set pulse is output to voltage generator 115 and sample and hold circuit 106 (step S500). Voltage generator 115 generates and delivers a voltage corresponding to the tempo data to sample and hold circuit 106, where it is sampled and held. As a result, the voltage is input to motor driver 107 and VCO (Voltage Controlled Oscillator) 113. As described above, disk 102 starts to rotate forward at a speed corresponding to the initial value of the tempo data and sequencer clock SQCK having a frequency corresponding to that speed starts to be output.

Control then passes to step S503, where AC 207 is cleared and SQ controller 203 sets a preset value of 0 in SQ counter 202 (step S504).

Subsequently, the current address count (=0) in AC 207 is incremented by one, and the event data at address "1" of FIG. 3 is read out of SQ memory 206, and a latch signal is output to event data latch 210. As a result, the event data at address "1" is latched by event data latch 210 through data converter 209 (step S505). In this case, since data converter 209 has received a rotational directional signal indicative of a forward direction rotation, the event data passes intactly through data converter 209. In the FIG. 3 example, the event data designating the note-on for note number C2 stored at address "1" is latched by event data latch 210.

Simultaneously, the address count in AC 207 is incremented by one. As a result, the event time data at address "2" is read out of SQ memory 206 in accordance with the address signal output from AC 207, and a latch signal is output to event time latch 205. As a result, the event time data at address 2 is latched by event time latch 205 (step S506). In the FIG. 3 example, the data on event time=12 stored at address "2" is latched by event time latch 205.

It is then determined whether the rotational direction of disk 102 is reversed (step S507). If not, it is determined whether comparator 204 has output a coincidence signal indicative of the coincidence of the event time data latched in event time latch 205 and the count of SQ count 202 (step S509).

When a predetermined time has elapsed and comparator 204 outputs a coincidence signal in a standby state in which steps S507 and 509 are iterated, control returns to step S505 through a determination at step S510. At step S505 AC 207 is incremented in the same manner as mentioned above, and the event data stored at an address next to the address where the event time data is stored is latched by event data latch 210 through data converter 209. Simultaneously, the address count in AC 207 is incremented by one, and event time data stored at the further next address is read out of SQ memory 206 and latched in event time latch 205 (step S506). Control then passes to a standby state where steps S507 and S509 are again iterated. In the above example, event data indicative of the note-off for note number C2 stored at address "4" next to address "3" where the data on event time=12 is stored and data on event time=24 stored at address 5 are sequentially read out.

Thereafter, until processes similar to those mentioned above are iterated, and the value in AC 207 indicates address N and determination at step S510 becomes YES, the event time and event data are sequentially latched and musical tone generator 211 gives an automatic performance on the basis of the contents of event data latch 210. In the example of FIG. 3, status sequentially changes, as shown in the upper portion of FIG. 6, in correspondence to the forward rotation of disk 102, and the respective events for the automatic performance occur sequentially.

If the user changes the rotational speed of disk 12 when the forward automatic performance is being given so in correspondence to the forward rotation of disk 102, the oscillating frequency of sequencer clock SQCK output from frequency divider 114 immediately changes accordingly. Therefore, the tempo of the automatic performance changes depending on the user's manipulation of disk 102. That is, the tempo of the automatic performance can be freely controlled.

When the user forcedly rotate disk 102 in the reverse direction when the forward automatic performance is being given in correspondence to the forward rotation of disk 102, the rotational direction detector 110 outputs a rotational direction signal indicative of the reverse direction rotation. Thus, the determination at step S507 becomes YES and the direction of reading SQ memory 206 is changed to a direction reverse to the reading direction maintained so far or to the direction in which the reading address is sequentially decreased. For example, when in the FIG. 3 example the current address is 12 and the count of SQ counter 202 is 62, it is assumed that the rotation of disk 102 is reversed from its forward direction to its reverse direction. In this case, "2" is decremented from address "12" and data on event time=48 at address "10" is latched newly in event time latch 205 (step S508).

Thereafter, it is determined whether the rotational direction of disk 102 is reversed (step S516). If not, it is determined whether comparater 204 has output a coincidence signal indicating that the event time whose data is latched in event time latch 205 has coincided with the count in SQ counter 202 (step S518). In the standby state where these steps S516 and 518 are iterated, the current signal indicative of the rotational direction indicates "reverse ", so that SQ counter 202 performs a decrementing operation each time it receives a sequencer clock SQCK. In the above example, the standby process at steps S516 and S518 is iterated until the count in SQ counter 202 coincides with event time=60 whose data is stored at address 10.

When time has elapsed and comparater 204 outputs a coincidence signal in the standby state where steps S516 and S518 are iterated, the determination at step S518 becomes YES and control passes to step S519, where the value in AC 207 is incremented by one and the event data stored at an address corresponding to that value is read out of SQ memory 206 and a latch signal is output to event data latch 210. In the case of the above example, event data designating the note off for the note number G2 stored at address 11 is read out of SQ memory 206. As a result, the read event data is latched by event data latch 210 through data converter 209 (step S519). In this case, since data converter 209 has received a signal indicative of the reverse rotational direction, it converts a note-on code to a note-off code and a note-off code to a note-on code in the received event data and outputs them to event data latch 210. In the above example, a code designating the note-off in the event data for note number G2 stored at address "11" is converted to a code designating note-on and the converted code is latched by event data latch 210. The reason why a note-on code and a note-off code are reversed will be described later.

Along with the above operation, control returns through the determination at step S520 to step S515, where the address count in AC 207 is decremented by 3. As a result, event time data is read out of SQ memory 206 on the basis of an address signal from AC 207 and a latch signal is simultaneously output to event time latch 205. As a result, the read-out data on the event time is latched in event time latch 205. In the above case, data on event time=48 at address 8 is read out and latched. Thereafter, a standby state appears where steps S516 and S518 are again iterated.

Until a process similar to that mentioned above is iterated and the value in AC 207 becomes the head address "0" and the determination at step S520 indicates YES, event time data and event data are sequentially latched, and musical tone generator 211 gives an automatic performance on the basis of the contents of event data latch 210 where the note-on and note-off codes are reversed. In the example of FIG. 3, status is sequentially changed in accordance with the reverse rotation of disc 102, as shown in a lower portion of FIG. 6, and the respective events for the automatic performance are sequentially generated.

As described above, while the user is rotating disc 102 reversely, data converter 209 receives a signal indicative of a reverse rotation. Thus, data converter 209 converts a note-on code to a note-off code and a note-off code to a note-on code in the received event data and outputs these converted data to event data latch 210. The reason why note-on and note-off codes are reversed is as follows.

In order that musical tone generator 211 generates a tone with a note number, it is required to deliver to musical tone generator 211 event data which changes the note with the note number to a note-on state and then event data which changes that note number to a note off state after a predetermined event time. In a polyphony, this sequential relationship is similar to that in the monophony as long as attention is paid to any particular note number. If the order of reading event data out of SQ memory 206 is reversed, the order of occurrence of note on and note off is reversed. Therefore, when the direction of reading out of SQ memory 206 is reversed, and immediately after note-off (note-on) for any particular note number of interest is generated, the note-off (note-on) for the same note number again occurs to thereby cause musical tone generator 211 to malfunction. As reverse reading out of SQ memory 206 advances, event data read out last becomes event data which designates the note-on at address 1 and hence a tone continues to be produced.

In order to prevent such situation, when event data is read out of SQ memory 206 in the reverse direction in the present embodiment, data converter 209 reverses the note-on and note-off codes in the received event data and outputs the resulting codes to event data latch 210. As will be seen in the example of FIG. 7, when disc 102 rotates in the reverse direction, the commands of note-on and note-off in the event data read out of SQ memory 206 are reversely converted. Thus, it will be seen that compared to the forward rotation of disc 102 the order of reproduction of the respective notes is completely reversed with the relationship in time between the respective notes performed automatically being maintained. As a result, a musical effect is produced which is similar to that produced by the reverse rotation of a record.

Figure 6:
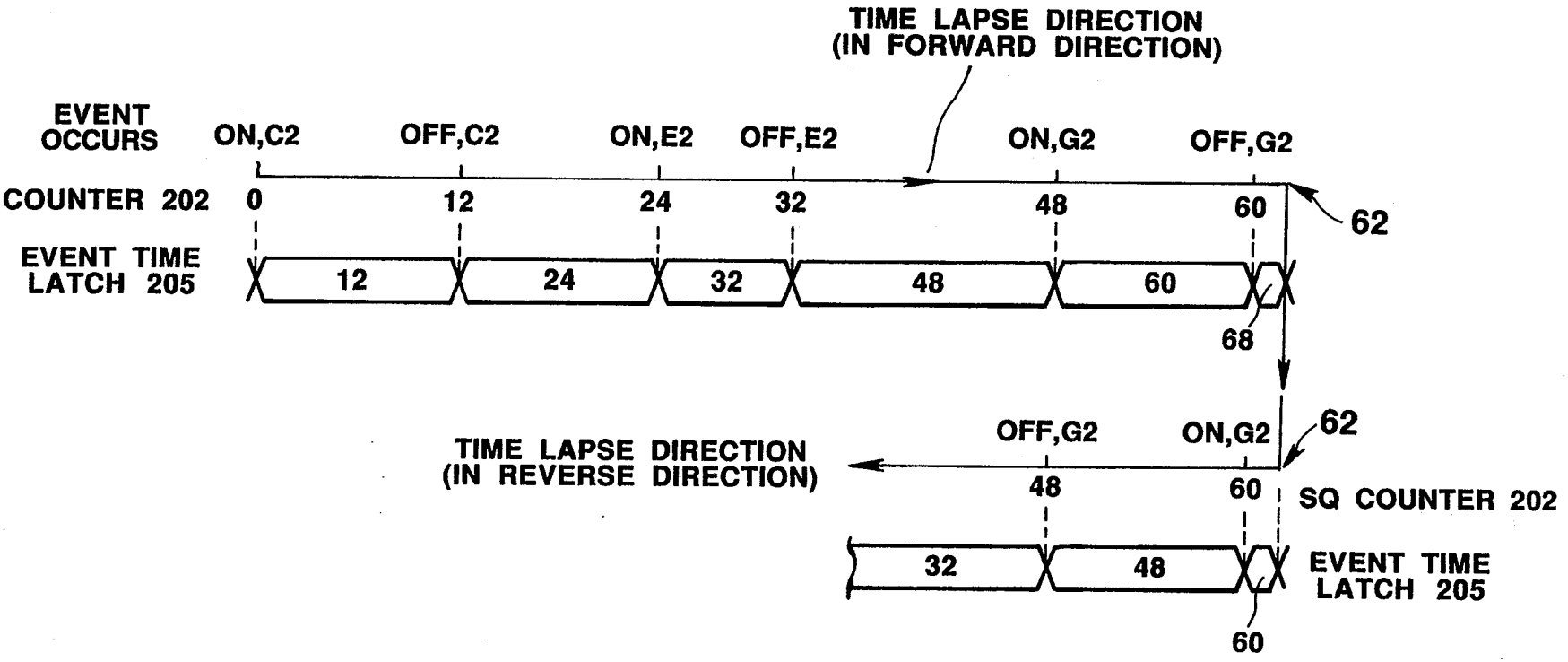
FIG. 6 illustrates the operation of an automatic performance (in the case of a monophony).
Figure 7:
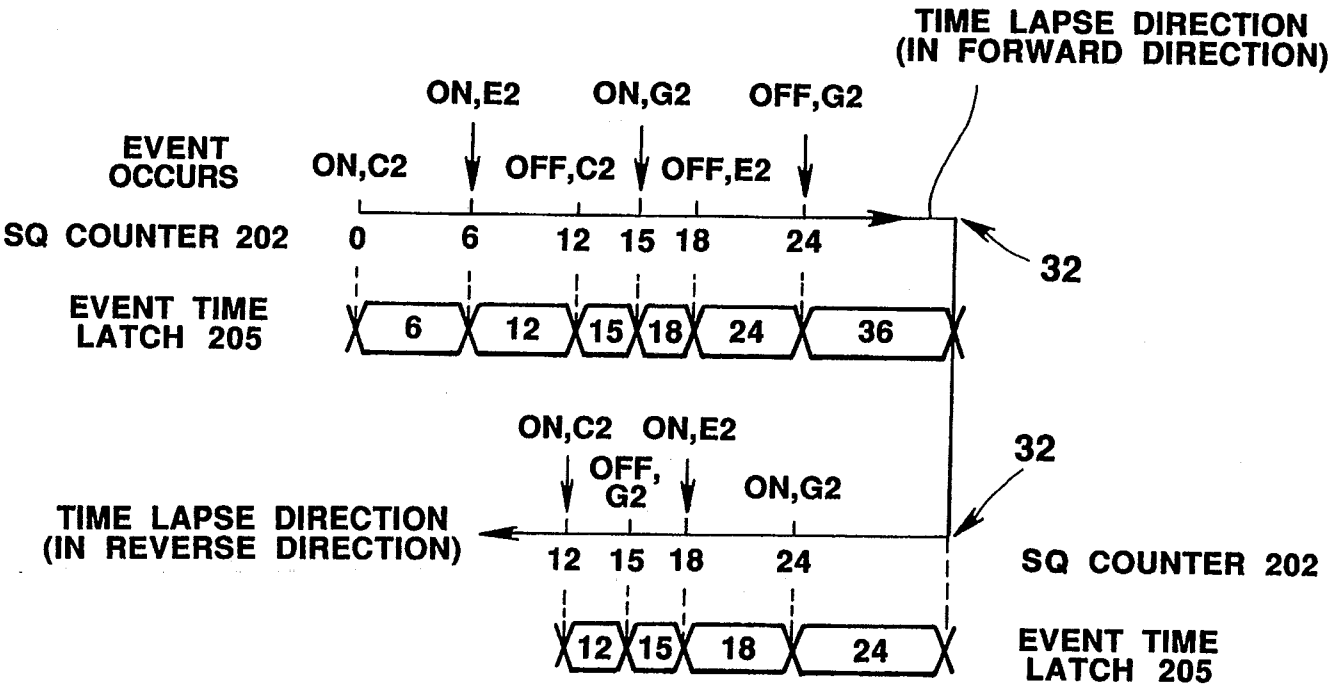
FIG. 7 illustrates the operation of an automatic performance (in the case of a polyphony).

FIG. 6 shows an automatic performance corresponding to that of FIG. 3 which is an example of the stored contents of SQ memory 206 in the case of automatic performance in a monophony while FIG. 7 shows an automatic performance corresponding to FIG. 4 which shows an example of the stored contents in SQ memory 206 where an automatic performance is given in a polyphony. Also, in the polyphony, the order of reproduction of the respective notes is completely reversed with the relationship in time between the respective notes performed automatically compared to the forward rotation of disc 102 being maintained when the disc 102 is rotated reversely as in the monophony.

As described above, when the user changes the rotational speed of disc 102 when the reverse automatic performance is being given in correspondence to the reverse rotation of disc 102, the oscillating frequency of sequencer clock SQCK output from frequency divider 114 immediately changes as in the forward rotation of the disc. Therefore, the tempo of the automatic performance changes depending on the manipulation of the user on disc 102 to thereby control the tempo of the reverse automatic performance freely.

When the user forcedly rotates disc 102 in the original forward direction while a reverse automatic performance is being given in correspondence to the reverse rotation of disc 102, the rotational direction signal output from rotational direction detector 110 again indicates a forward rotation. Therefore, determination at step S516 becomes YES, so that the direction of data reading out of SQ memory 206 is changed reversely to the direction of reading made so far or to the original forward direction in which read address is sequentially incremented (step S517). For example, assuming that the current address is 4 in the example of FIG. 3, that address is incremented by 2 and data on event time=32 at address "6" is newly latched in event time latch 205.

Thereafter, control returns to a forward standby state where steps S507 and S509 of FIG. 5(*a*), mentioned above, are iterated, and a process for a forward automatic performance similar to that mentioned above is executed.

When the value in AC 207 indicates address N and determination at step S510 becomes YES in the processing for the forward automatic performance, or when the value in AC 207 indicates address "1" next to the head address in the process for the reverse automatic performance and determination at step S520 becomes YES, SQ controller 203 outputs a clear signal to sample and hold circuit 106 at step S511 because no more event data for automatic performance is stored in SQ memory 206 in the direction of the current automatic performance. As a result, motor driver 107 stops the drive of motor 108 to stop the rotation of disc 102 and the generation of sequencer clock SQ through frequency divider 114 from VCO 113 to thereby stop the automatic performance.

Thereafter, control passes to determination at step S501, where it is determined whether a touch signal has been output from touch detector 111. If not, it indicates that the user has again manipulated disc 102.

In order to determine whether disc 102 rotates in a forward direction or in a reverse direction, it is determined whether a signal indicative of the direction of rotation output from direction detector 110 indicates the forward direction or the reverse direction (step S502).

When disc 102 rotates in the forward direction, control passes to step S503, where a process for automatic performance in the forward direction and similar to that mentioned above is executed.

When it is determined at step S502 that the rotational direction signal indicates a reverse rotation, or the user rotates disc 102 in the reverse direction at the start of the automatic performance, a value indicative of the last address but one in SQ memory 206 is set in AC 207 (step S512). In the example of FIG. 3, value N indicative of an address in SQ memory 206 is set in AC 207. Stored at the last address but one in SQ memory 206 is data on an event time equal to that stored at an address which precedes the former address by two addresses. Stored at address N in the example of FIG. 3 is data on an event time equal to event time=9528 whose data is stored at address N−2. As a result, the data on the event time read out of the last address but one in SQ memory 206 is input to SQ controller 203.

Subsequently, SQ controller 203 presets in SQ counter 202 a value $D_N$ equal to that of event time whose data is stored at the last address but one in SQ memory 206 (step S513). In the example of FIG. 3, a value of 9528 is preset in SQ counter 202.

Thereafter, the current address count in AC 207 is decremented by one, and event data at the last address but two is read out of SQ memory 206 and a latch signal is output to event data latch 210. As a result the event data at that address is latched through data converter 209 by event data latch 210 (step S514). In this case, since a signal indicative of the reverse rotational direction is input to data converter 209, data converter 209 converts a note-off code to a note-on code in the received event data and outputs the converted code to event data latch 210. In the example of FIG. 3, a note-off code is converted to a note-on code in the event data for note number D3 stored at address N−1 and is latched in event data latch 210.

Simultaneously with the above operation, the address count in AC 207 is decremented by three and, as a result, event time data is read out of SQ memory 206 on the basis of an address signal from AC 207 and simultaneously, a latch signal is output to event time latch 205. As a result, the read event time data is latched in event time latch 205 (step S515). In the example of FIG. 3, data on event time=9504 at address N−4 is read out and latched. Thereafter, control passes to a standby state where steps S516 and S518 are iterated.

Thereafter, a process for automatic performance in the reverse direction similar to that mentioned above is iterated, event time data and event data are sequentially latched, musical tone generator 211 gives an automatic performance on the basis of the contents in event data latch 210 where note-on and note-off codes are alternately reversed to each other until the value in AC 207 becomes the head address "0" at which time the determination at step S520 becomes YES.

By the above operation, the user can freely change the rotational speed of disc 102, stop the rotation of disc 102 or change the direction of rotation of disc 102. The user can freely change or stop the tempo of the automatic performance in accordance with a change in the rotational speed of disc 102 and further can freely change the direction of automatic performance in accordance with a change in the rotational direction of disc 102. AS described above, in the present embodiment, the rotational state of disc 102 can be directly reflected on the state of the automatic performance to thereby realize a user interface very excellent for changing the state of the automatic performance intentionally.

Figure 8:
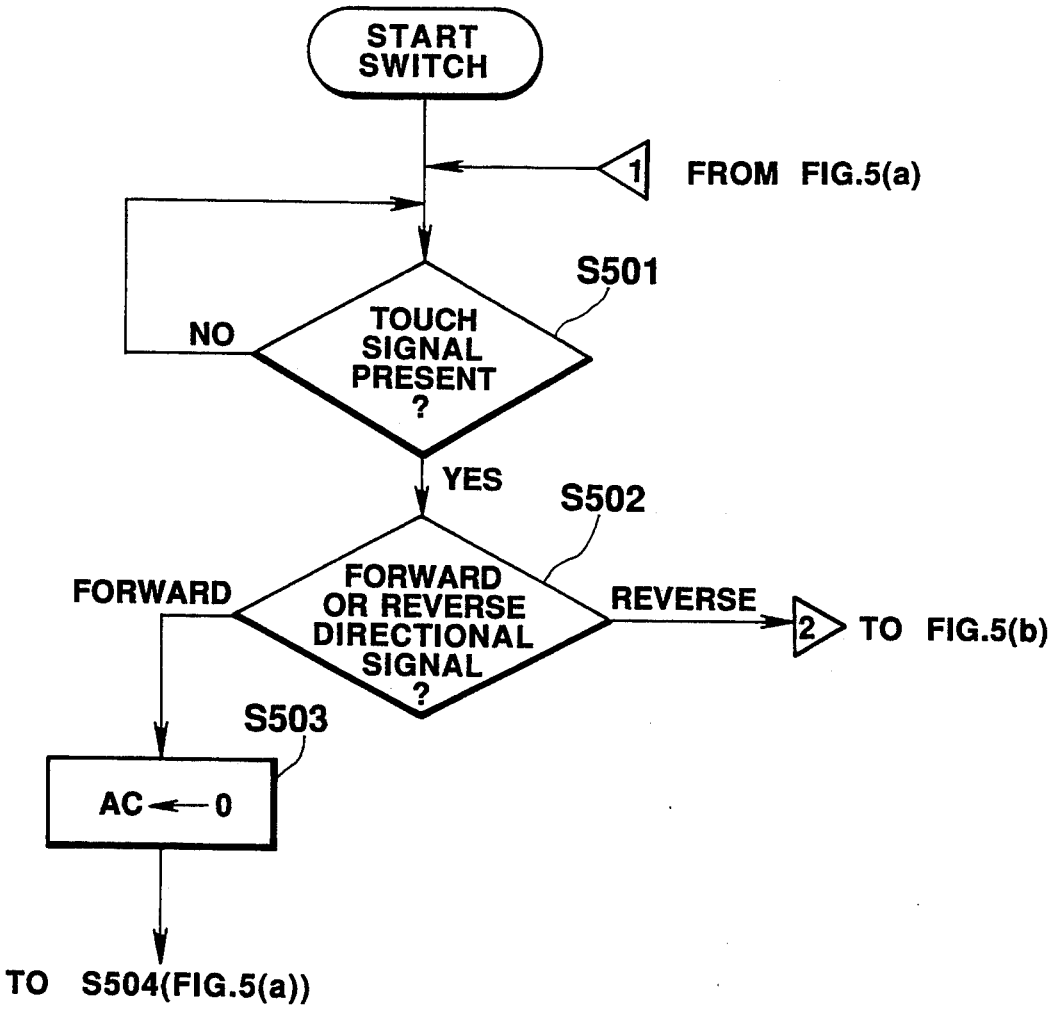
FIG. 8 is a modification of an operation flowchart for the SQ controller.

In the above embodiment, data on the tempo stored at the last address (N+1) in SQ memory 206 was used as an initial value to thereby rotate disc 102 from the beginning of the automatic performance. Alternatively, arrangement may be such that automatic performance starts when the user himself has rotated disc 102 while maintaining disc 102 stopped directly after a command to start the automatic performance has issued without rotating disc 102 from the beginning. In this case, no data on the tempo is required to be stored in SQ memory 206 and neither is voltage generator 115 of FIG. 1 required. In this case, as shown in FIG. 8, SQ controller 203 turns on AND gate 201 after start switch 208 is switched on, and then performs the operations at step S501 seqq. The subsequent respective operations are similar to those in FIGS. 5(*a*) and 5(*b*), as mentioned. In this example, an automatic performance can be given at a tempo which the user desires from the beginning of the automatic performance.

In the first embodiment, since rotary disc 102 is rotating at all times to the tempo of the automatic performance, the tempo can visually be confirmed, advantageously.

Second Embodiment Composed of Tempo Setting Unit 100B and Sequencer 200

A second embodiment composed of tempo setting unit 100B and sequencer 200 will be described below.

Figure 9:
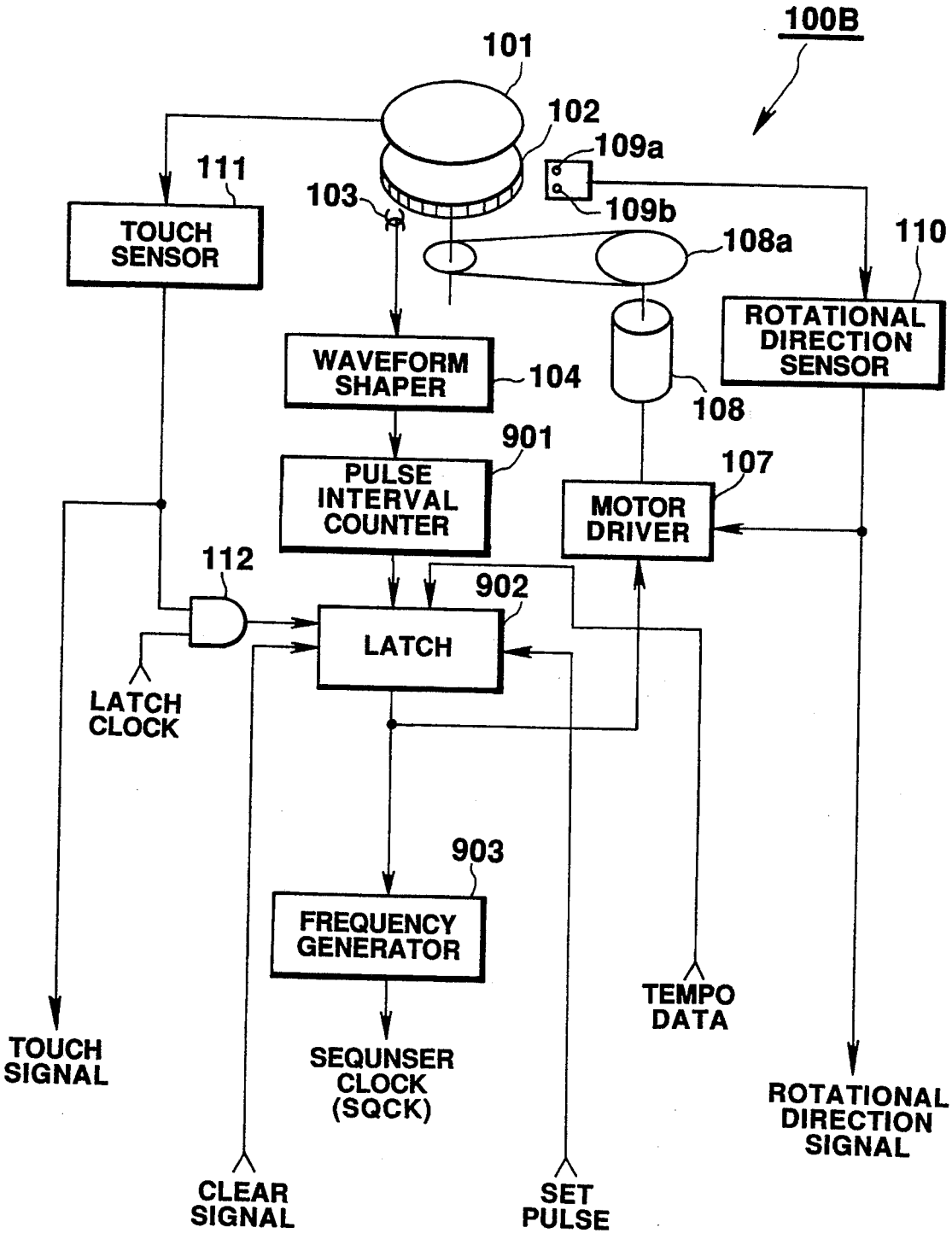
FIG. 9 shows the overall structure of a tempo setting unit 100B (second embodiment).

FIG. 9 shows the overall structure of tempo setting unit 100B.

In the second embodiment of FIG. 9, unlike the first embodiment of FIG. 1 where a pulse signal having a frequency directly proportional to the rotational speed of disc 102 read out through reproduction head 103 and waveform shaper 104 is converted by FV converter 105 to a voltage corresponding to a frequency which, in turn, corresponds to the rotational speed of disc 102, pulse interval counter 901 counts the interval between any adjacent pulses of the pulse signal, for example, as the number of pulses of a predetermined basic clock.

The digital value which is the inverse of the number of clock pulses is calculated as a digital value corresponding to the rotational speed of disc 102. The digital value is latched by latch 902 in accordance with a latch clock received from a clock generator (not shown) through AND gate 112 in response to a touch signal input from touch detector 111 to AND gate 112 turning on AND gate 112 while the user is touching the disc.

In this way, while the user is rotating disc 102, latch 902 sequentially latches pulse counts output from pulse interval counter 901. When the user releases disc 102 from his fingers, a count corresponding to the rotational speed of disc 102 at that time is latched and input to motor driver 107, which drives motor 108 at a rotational speed corresponding to the pulse count, and motor 108 transmits its torque through a pulley-belt mechanism 108*a* to disc 102.

A pulse count output from latch 902 is delivered to frequency generator 903, which oscillates at a frequency corresponding to the pulse count and supplies its oscillating output as sequencer clock SQCK.

By connecting tempo setting unit 100B which realizes the above operations to sequencer 200 of FIG. 2, the second embodiment operates in exactly the same manner as the first embodiment provided with tempo setting unit 100A and sequencer 200.

When the user switches on start switch 208 of sequencer 200 of FIG. 2 at the beginning of an automatic performance, SQ controller 203 of FIG. 2 outputs a clear signal to clear latch 902, and outputs to voltage generator 115 the tempo data stored beforehand in SQ memory 206 of FIG. 2, as described with reference to FIG. 3 or 4 and, simultaneously, outputs a set pulse to latch 902.

As a result, the tempo data is latched by latch 902. This data is input to motor driver 107 and frequency generator 903.

Motor driver 107 starts to drive motor 108 at a rotational speed corresponding to the tempo data. As a result, disc 102 which was stationary so far starts to rotate on the basis of the tempo data set initially.

Frequency generator 903 oscillates at a frequency corresponding to the tempo data and outputs its oscillating output as sequencer clock SQCK. In this way, sequencer clock SQCK having a frequency corresponding to the initial rotational speed of disc 102 is obtained, so that the sequencer starts an automatic performance at a tempo corresponding to the frequency of sequencer clock SQCK.

Also, in this case, arrangement is such that unless the tempo data is delivered to latch 902 at the beginning, an automatic performance starts when disc 102 is rotated.

Third Embodiment Composed of Tempo Setting Unit 100C and Sequencer 200

A third embodiment composed of tempo setting unit 100C and sequencer 200 will be described below. In the first embodiment 100A of FIG. 1 or the second embodiment 100B of FIG. 9 for the tempo setting unit, the user sets the tempo of an automatic performance and selects the direction of the automatic performance by rotating disc 102. In order to maintain the rotation of the disc 102 after the user releases disc from his fingers, the motor for driving the disc was used. In contrast, the third embodiment having tempo setting unit 100C, to be described below, produces the same effect as the first and second embodiments without using such motor.

The third embodiment is characterized in that the user operates a command inputting unit which will be described below, in place of disc 102 of the first or second embodiment of the tempo setting unit (FIG. 1 or 9), to cause an electronic display, for example, of an LED, to display the tempo and direction of automatic performance visually and directly.

Before description of the overall structure and operation of the third embodiment of the tempo setting unit, two embodiments of the command inputting units will be described below.

First Embodiment of Command Inputting Unit

A so-called track ball inputting unit may be used as a first embodiment of the command inputting unit.

Figure 11:
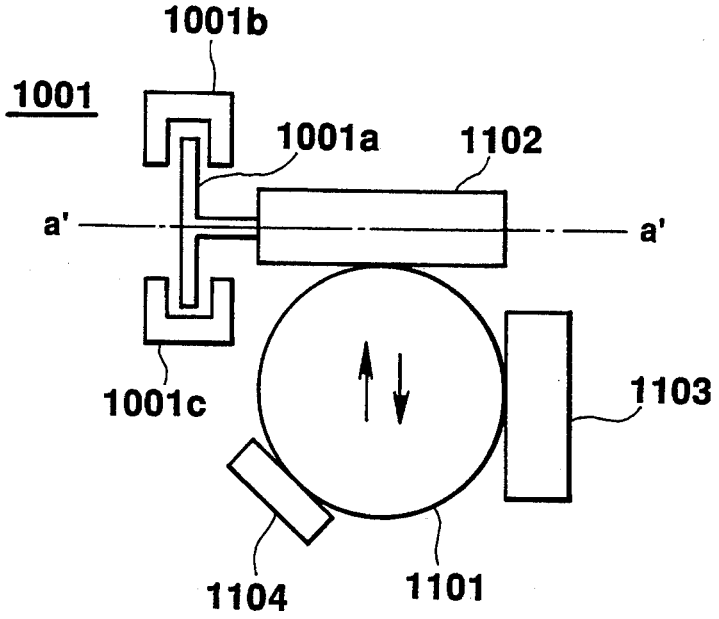
FIG. 11 shows the structure of a first command inputting unit in the tempo setting unit 100C (third embodiment).

FIG. 11 is a plan view of the first embodiment of the command inputting unit. In FIG. 11, a track ball 1101 is supported by three rod-like rollers 1102, 1103 and 1104.

When the user rotates such track ball 1101 directly with his fingers in the direction of arrow in place of disc 102 of FIG. 1, roller 1102 contacting the ball rotates around rotational axis a—a'.

As a result, disc 1001*a* of an optical rotary encoder 1001 rotates which has the same rotational shaft a—a' and is attached to roller 1102. Disc 1001*a* has in its peripheral portion a predetermined number of slits arranged shown in FIG. 12 and two sets of photo sensors 1001*b* and 1001*c* each set of which is composed of a light emitting diode and a light receiving photodiode provided so as to hold disc 1001*a* therebetween.

Figure 12:
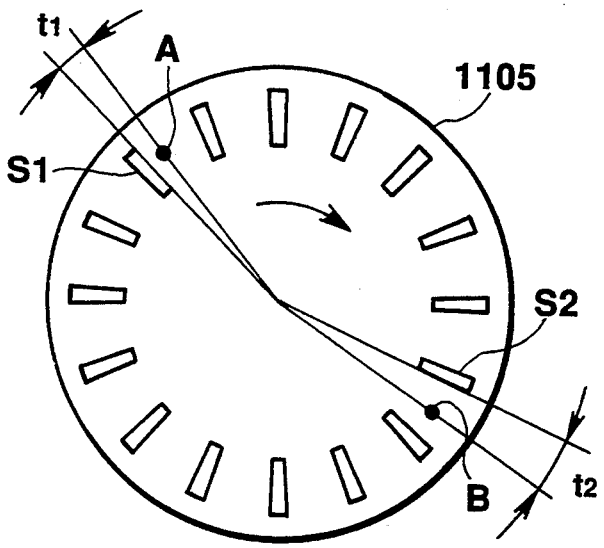
FIG. 12 shows the positional relationship between slits on a disk of a rotary encoder and photosensors.

As will be shown in FIG. 14, which will be described in more detail later, these two sets of photosensors 1001*b* and 1001*c* are provided at positions, for example, points A and B of FIG. 12, where the phases of the waveforms output from the respective photosensors substantially but not completely overlap.

Second Embodiment of Command Inputting Unit

Figure 13:
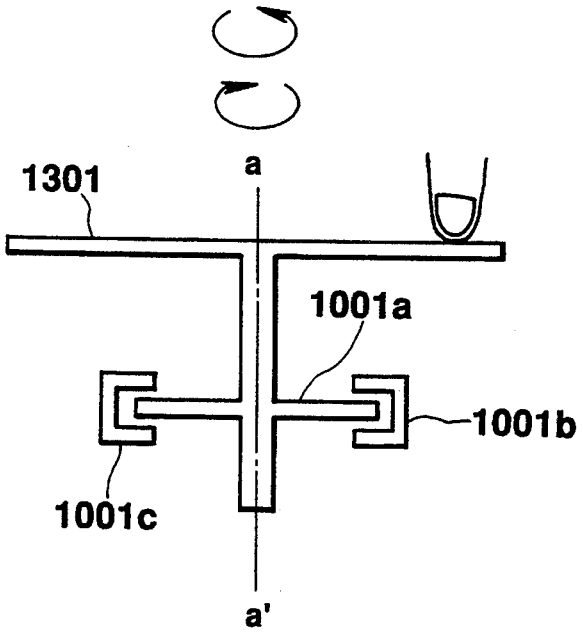
FIG. 13 shows the structure of a second command inputting unit in the tempo setting unit 100C (third embodiment).

FIG. 13 is a plan view of a second embodiment of the command inputting unit. In FIG. 13, disc 1001*a* and photosensors 1001*b*, 1001*c* similar to those of FIG. 11 are part of the rotary encoder. Disc 1301 having a center on rotational axis a—a' of disc 1001*a* is fixed perpendicular to rotational axis a—a'. The positions where photosensors 1001*b* and 1001*c* are attached are similar to those of FIG. 11.

When the user rotates disc 1301 with his fingers in a forward/reverse direction in such command inputting unit, photosensors 1001*b* and 1001*c* output pulses of a number corresponding to the rotational speed of disc 1301.

The Overall Structure and Operation of Tempo Setting Unit 100*c*

Figure 10:
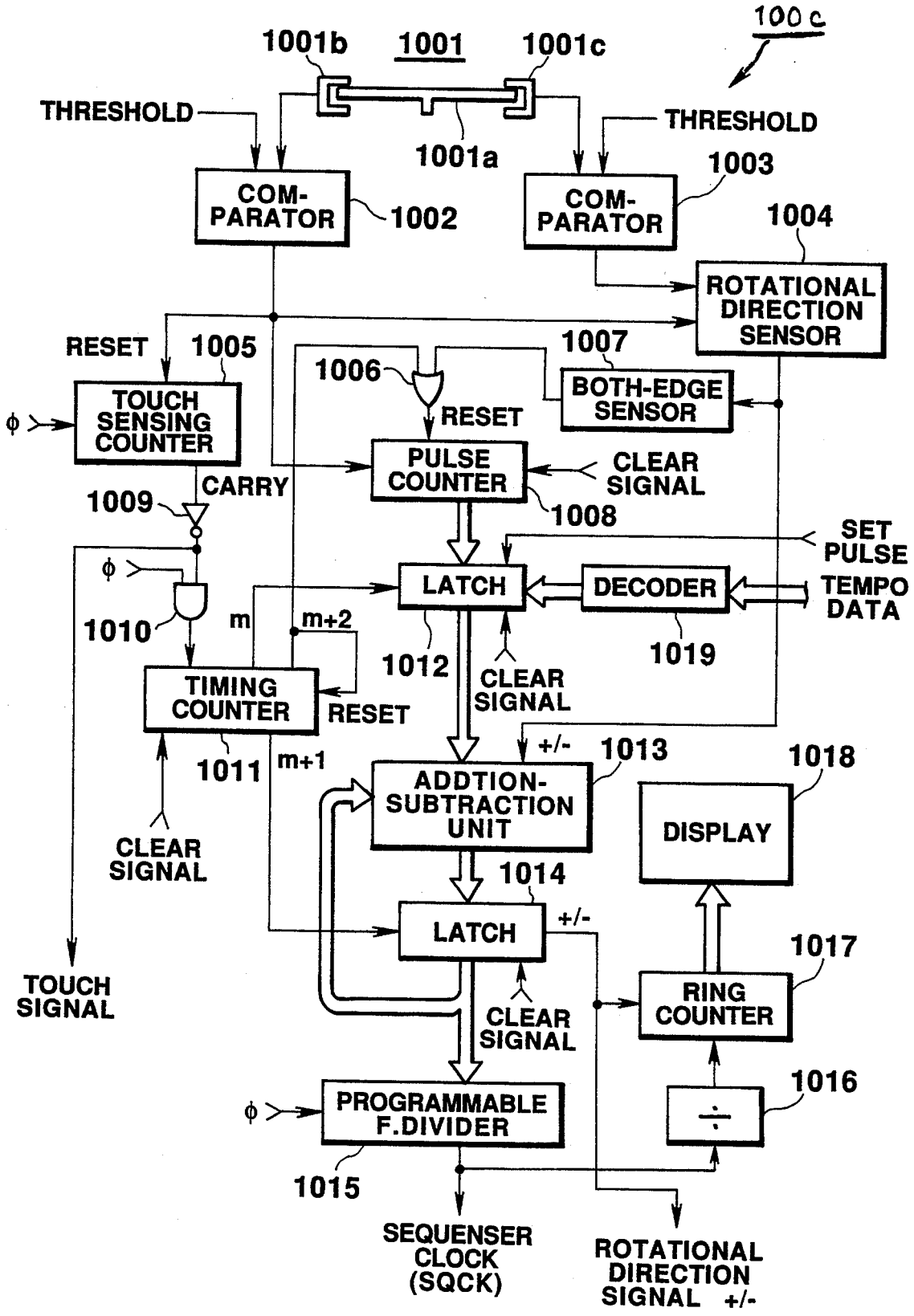
FIG. 10 shows the overall structure of the tempo setting unit 100C (third embodiment).

The overall structure of the third embodiment of the tempo setting unit 100*c* having the first or second embodiment of the command inputting unit is shown in FIG. 10.

In FIG. 10, reference numeral 1001 denotes a rotary encoder of the command inputting unit of FIG. 11 or 13, and track ball 1101 (FIG. 11) or disc 1301 (FIG. 13) which the user directly touches and operates is omitted.

A signal having a frequency corresponding to the rotational speed of disc 1001*a* is output from photosensors 1001*b* and 1001*c* in rotary encoder 1001 to comparators 1002, 1003, where the respective amplitudes of the signals are compared to a predetermined threshold. As a result, comparators 1002 and 1003 output pulse waveforms different in phase depending on the forward-/reverse direction of rotation to rotational direction detector 1004, as shown in FIG. 14.

Figure 14:
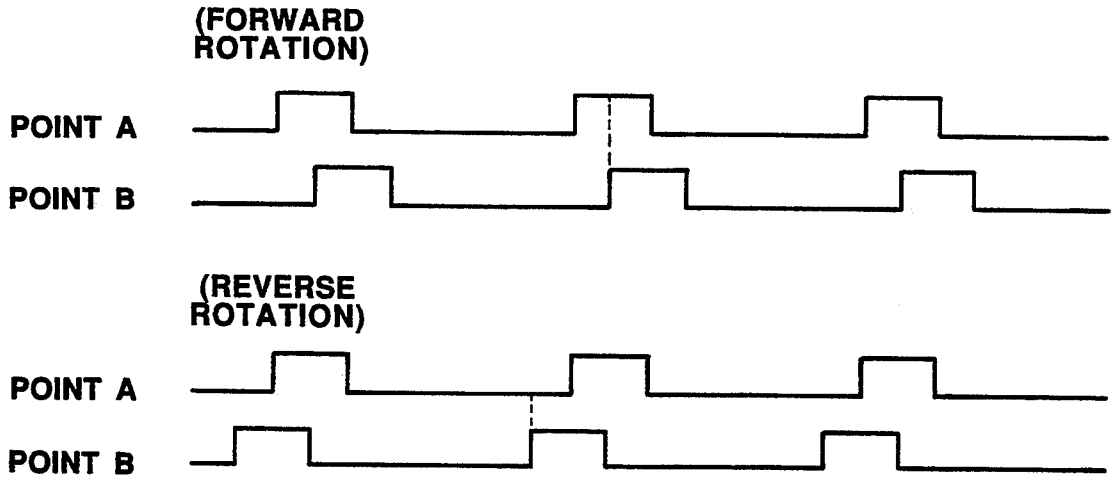
FIG. 14 shows an waveform output from a comparator in the tempo setting unit 100C (third embodiment).

As shown in FIG. 14, in rotational direction detector 1004, it is determined by a rise in the pulse waveform from, for example, photosensor 1001*c* on the B point side whether the output of the A point side photosensor 1001*b* is at high level or at low level. If it is at high level, it is determined that the rotational direction of disc 1001*a* is forward while if otherwise, it is determined that the rotational direction is reverse.

In order to detect the rotational speed of disc 1001, a pulse waveform from comparator 1002 is output to a reset terminal of touch detection counter 1005 and a clock count terminal of pulse counter 1008.

Touch detector counter 1005 always counts basic clocks $\phi$ from the clock generator (not shown). If the count arrives at a predetermined value, counter 1005 outputs a carry to invertor 1009. When disc 1001 is in a rotational state by the operation of the user on track ball 1001 (FIG. 11)or disc 1301 (FIG. 13), touch detection counter 1005 is reset at appropriate intervals of time with a high level of the pulse waveform output from comparator 1002. As a result, touch detection counter 1005 outputs no carry, but the invertor 1009 output becomes high. Conversely, when the user stops his operation on track ball 1101 or disc 1301 and disc 1001 is brought into a stop state, touch detection counter 1005 outputs a carry after a predetermined time without being reset, and as a result, the invertor 1009 output becomes low.

The output signal from invertor 1009 is used as a touch signal as in the first embodiment (FIG. 1), or second embodiment (FIG. 9), of the tempo setting unit.

Pulse counter 1008 counts pulses output from comparator 1002 depending on the rotational speed of disc 1001*a*.

Timing counter 1011 counts basic clocks $\phi$ because AND gate 1010 is on as long as a touch signal from invertor 1009 is at high level, and it outputs a latch signal to latch 1012 at a timing when a time corresponding to count m from the count start point has elapsed (hereinafter referred to as m-timing). As a result, the count in pulse counter 1008 is latched in latch 1012.

The count latched in latch 1012 is delivered to addition-subtraction unit 1013, where the count is added to, or subtracted from, the last value accumulated so far in latch 14. Addition-subtraction circuit 1013 executes addition if the output from rotational direction detector 1004 indicates a forward direction while it executes subtraction if the output from rotational direction detector 1004 indicates a reverse direction. At a timing when the count becomes m+1, timing counter 1011 outputs a latch signal to latch 1014 to thereby latch the result of the accumulation in latch 1014.

A sign of the result of the accumulation latched in latch 1014 is output as a rotational direction signal to a ring counter 1017, to be described later in more detail.

Programmable frequency divider 1015 divides the basic clock $\phi$ by the absolute value of the accumulated count latched in latch 1014 and produces sequencer clock SQCK having the resulting frequency.

Pulse counter 1008 is reset through OR gate 1006 when the count in timing counter 1011 becomes m+2 or when the signal output from rotational direction detector 1004 changes so that both-edge detector 1007 outputs a pulse signal.

Sequencer clock SQCK of FIG. 10 is output along with a touch signal and a rotational direction signal to the circuit of the FIG. 2 embodiment of the sequencer. As a result, this circuit realizes an automatic performance such as that mentioned above.

By the above operation, each time the user manipulates track ball 1001 (FIG. 11)or disc 1301 (FIG. 13) to rotate disc 1001, a pulse count corresponding to the quantity of its rotation is accumulated through latch 1012 by addition-subtraction unit 1013 and latched by latch 1014 at constant intervals of time.

When the user releases track ball 1101 or disc 1301 from his fingers, the sequencer clock SQCK maintains its frequency at a constant value because latch 1014 holds a constant accumulated value, so that the speed of the automatic performance given by the FIG. 2 sequencer is maintained constant.

When the user sequentially operates track ball 1101 or disc 1301 in the forward direction, the accumulated value latched in latch 1014 sequentially increases, so that the frequency of sequencer clock SQCK sequentially increase, and hence the speed of the automatic performance given by the FIG. 2 sequencer gradually increases.

Conversely, when the user operates track ball 1101 or disc 1301 sequentially in the reverse direction, the accumulated value latched in latch 1014 gradually decreases, so that the frequency of sequencer clock SQCK gradually decreases and hence the speed of the automatic performance given by the FIG. 2 sequencer gradually decreases.

When the user gradually operates track ball 1001 or disc 1301 in the reverse direction until the accumulated value latched in latch 1014 becomes 0, programmable frequency divider 1015 does not output sequencer clocks SQCK any longer, so that the automatic performance given by the FIG. 2 sequencer is stopped.

Further, when the user gradually operates track ball 1101 or disc 1301 in the reverse direction to thereby increase the absolute value of the accumulated value latched in latch 1014, the frequency of sequencer clock SQCK output from programmable frequency divider 1015 again increases and the rotational direction signal indicates a reverse direction. Therefore, reverse automatic performance is given at a speed corresponding to the frequency of sequencer clock SQCK in sequencer 200 of FIG. 2.

Figure 15:
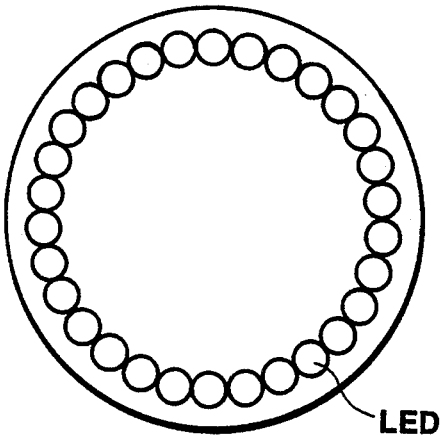
FIG. 15 shows the appearance of a display in the tempo setting unit 100C (third embodiment).

Sequencer clock SQCK output from programmable frequency divider 1015 is divided further by frequency divider 1016, the output of which is counted by ring counter 1017, the output of which sequentially lights LEDs arranged along the periphery of a circle on display 1018 as shown in FIG. 15. The counting direction of ring counter 1017 changes depending on whether the accumulated value latched in latch 1014 is positive or negative. Therefore, the user can visually recognize the current tempo and direction of the automatic performance in accordance with the speed and moving direction of lighting of the respective LEDs (FIG. 15) on display 1018.

When the user switches on start switch 208 of sequencer 200 of FIG. 2 at the start of the automatic performance, a clear signal from SQ controller 203 of FIG. 2 clears pulse counter 1008, and latches 1012 and 1014. Thereafter, SQ controller 203 outputs to decoder 1019 the tempo data stored beforehand in SQ memory 206 of FIG. 2, as mentioned above in FIG. 3 or 4. Simultaneously, a set pulse is output to latch 1012. Decoder 1019 outputs a pulse count corresponding to the tempo data and the count is latched by latch 1012 in accordance with the set pulse. This data is output to addition-subtraction unit 1013.

The initial count value latched by latch 1012 is latched by latch 1014 through addition-subtraction unit 1013 in accordance with a latch signal from timing counter 1011 at a timing when the count in timing counter 1011 becomes m+1.

As a result, the frequency of sequencer clock SQCK output through programmable frequency divider 1015 becomes a value corresponding to the initial tempo data mentioned above, and automatic performance starts at the initial tempo corresponding to the value. Simultaneously, sequencer clock SQCK is counted by ring counter 1017 through frequency divider 1016, so that the respective LEDs on display 1018 light and move at a speed corresponding to the initial tempo data.

By connection of the third embodiment of the tempo setting unit 100C which realizes the above operation to the circuit of the embodiment of the FIG. 2 sequencer 200, a very excellent user interface for changing the state of the automatic performance intentionally is realized without the need for a mechanical drive unit such as is shown in the first or second embodiment of the tempo setting unit 100A or 100B.

Also, in this case, unless tempo data is delivered to latch 1012 at the beginning, no automatic performance starts until the user operates the command inputting unit.

While in the third embodiment of the tempo setting unit 100C, the user rotates track ball 1101 (FIG. 11) or disc 1301 (FIG. 13) to rotate rotary encoder 1001, and as a result, the tempo of automatic performance and the forward/reverse direction of the performance are selected, the present invention is not limited to them. For example, by rotating a rotary shaft of a variable resistor in any direction, a similar operation is achieved.

While in the above embodiment the respective LEDs arranged along the periphery of the circle on the display are sequentially lighted, the present invention is not limited to the use of those LEDs, but other light emitting devices such as liquid crystal units may be used. While the light emitting elements are arranged along the periphery of the circle, they may be arranged on the periphery of an ellipse, of course.

Fourth Embodiment

Figure 16:
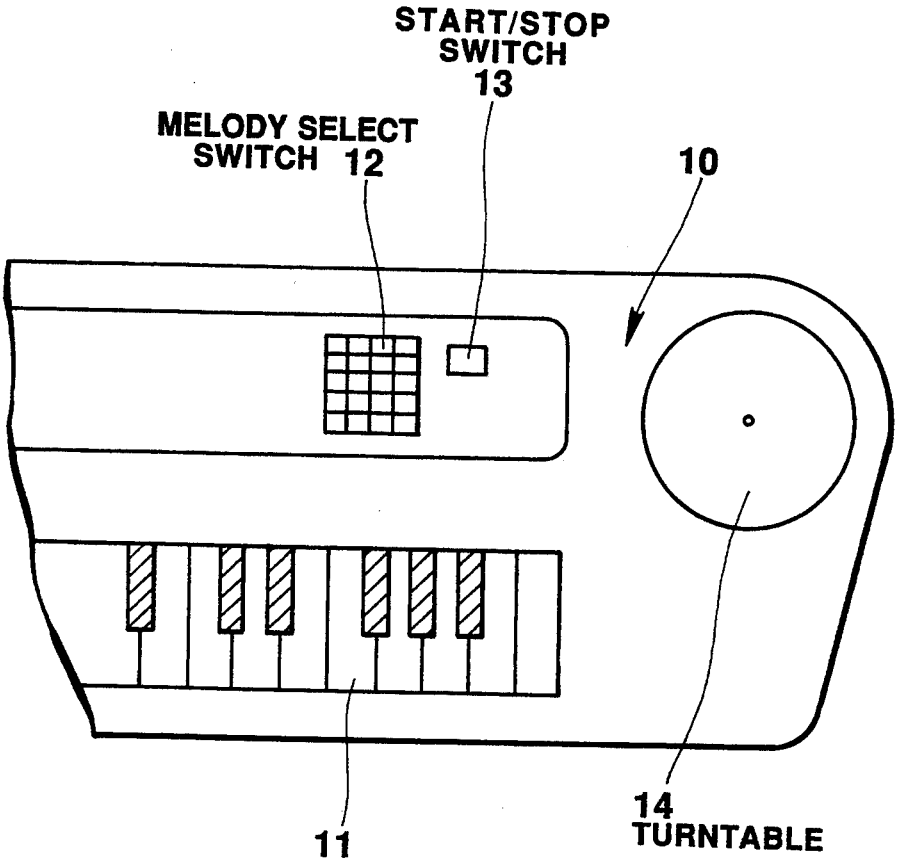
FIG. 16 is a plan view of a fragmentary musical instrument proper of a fourth embodiment.
Figure 18:
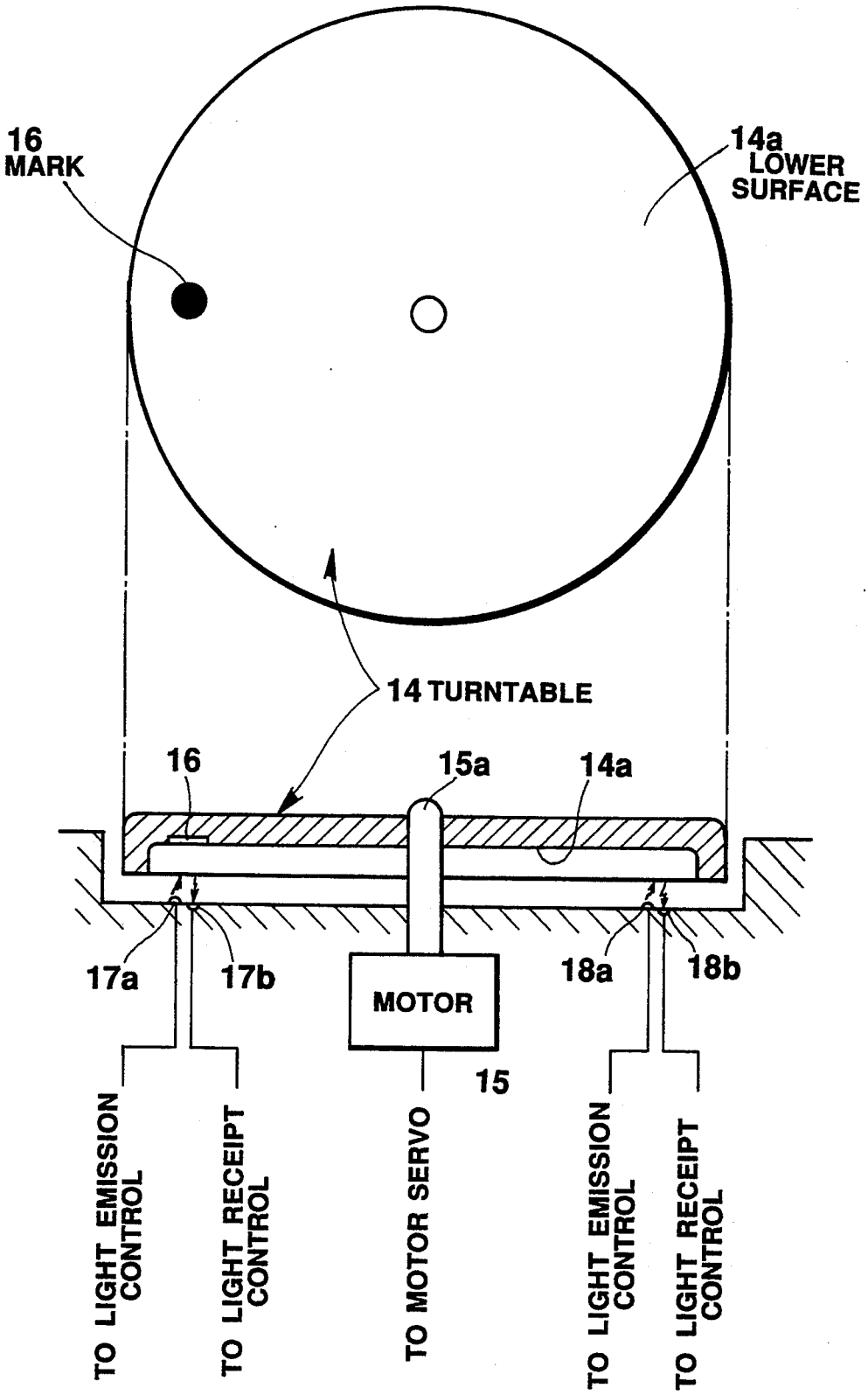
FIG. 18 is a cross-sectional view and a back view of a turntable provided in the fourth embodiment.

A fourth embodiment of the present invention will be described below with reference to the drawings. This embodiment is applied to an electronic keyed instrument. FIG. 16 shows the appearance of part of the electronic instrument of the present embodiment. Instrument body 10 is provided with a keyboard 11, the respective keys of which have a keyboard switch, melody select switch 12, start/stop switch 13, and turntable 14. As shown in FIG. 18, turntable 14 is fixed to the rotational shaft 15*a* of motor 15 and has a black mark 16 on its lower surface 14*a*. Instrument body 10 is provided with a first pair of light emission element 17*a* and adjacent light receipt element 17*b* and a second pair of light emission element 18*a* and adjacent light receipt element 18*b* at positions distant 180 degrees from each other and facing the rotational orbit of the mark. Thus, the light emitted from the respective light emission elements 17*a* and 18*a* is reflected by lower turn table surface 14*a* and detected by light receipt elements 17*b* and 18*b*, respectively.

Figure 17:
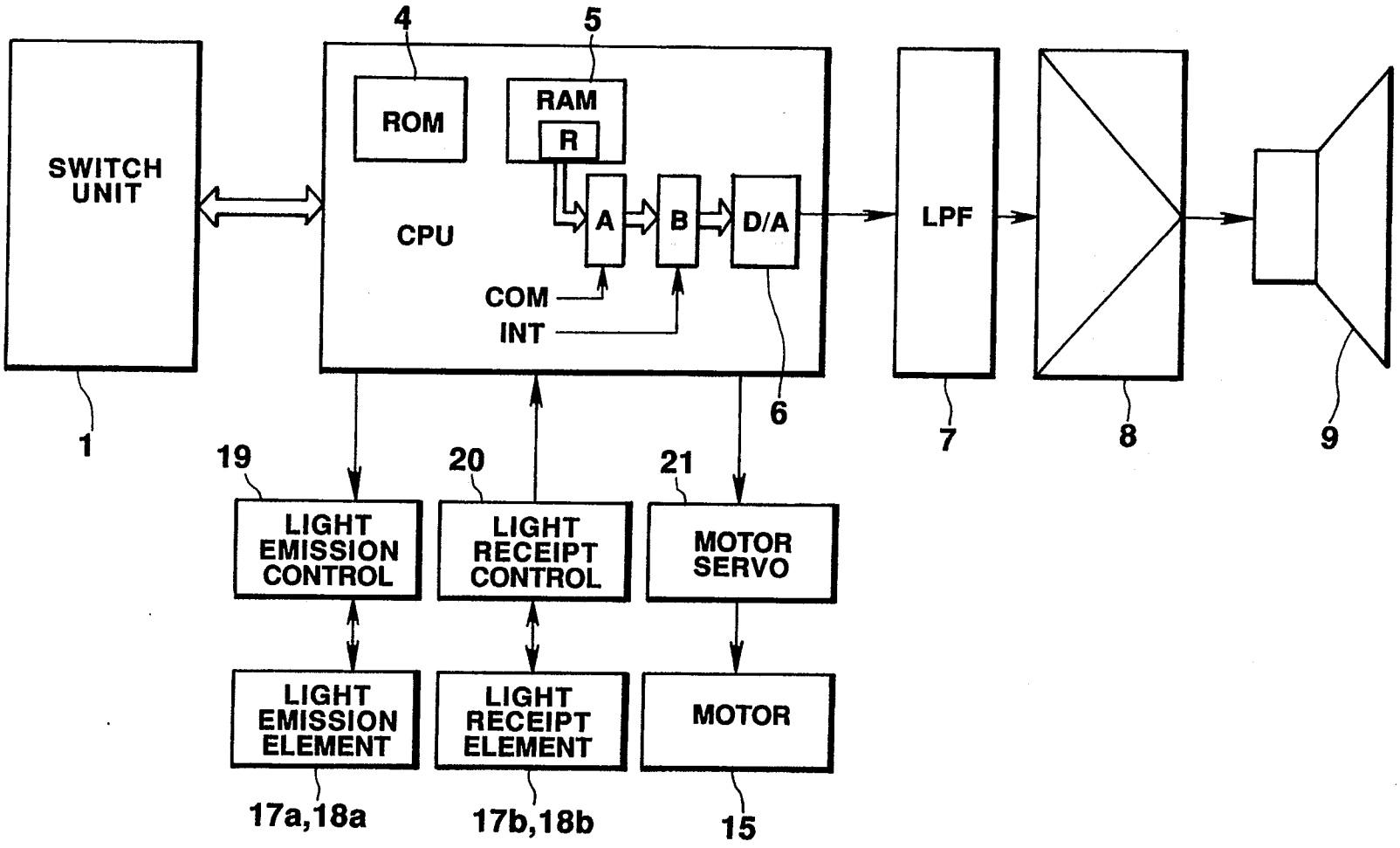
FIG. 17 is a block diagram indicative of the overall structure of an electronic musical instrument to which the fourth embodiment is applied.

In the overall block diagram of FIG. 17, motor servo 21 controls its output voltage in accordance with servo data received from CUP 3 and applies it to motor 15. Light emission control unit 19 controls the light emission of respective light emission elements 17*a* and 18*a* in accordance with a command from CPU 3. Light receipt quantity control unit 20 outputs a signal to CPU 3 when the respective quantities of light detected by light receipt elements 17*b* and 18*b* arrive at low level.

Data on the operation of melody select switch 12 and start/stop switch 13 is input from switch unit 1 to CPU 3, which provides the entire control required for the electronic musical instrument as well as performs a process for generation of a tone under program control without using tone source hardware for generation of the tone. ROM 4 has stored an overall processing program shown by a main routine, to be described later in more detail, a tone source processing program shown by a timer interrupt routine, envelop data (rate, level, etc. ), data on various parameters for control of tones such as pitch data, data on PCM tone waveforms, and data on automatic performance.

The pitch data is an address addition value used for reading out data on the musical tone waveform. When a key switch is switched on by depression of the corresponding key or data on a melody is read out, data on a tone pitch and data on waveform start address, waveform end address, and waveform loop address are stored in an intermediate data storage region prepared in working RAM 5. The automatic performance data, part of which is conceptually illustrated in FIG. 4, is data on melodies 1, 2, . . . stored at the corresponding addresses. Data on a standard tempo of each melody is stored at the header H of a storage region for that melody.

Prepared in RAM 5 are accumulating registers R which temporarily store data on musical tone waveforms for the respective channels (accumulated waveform value for 4 channels) produced by the tone source process in the timer interrupt routine, and the F, A, B registers, etc. of FIG. 5. The musical tone waveform data produced by the timer interrupt routine is latched by latch A which operates in response to a signal COM from a controller which is provided with an instruction decoder (not shown) in CPU 3 and then input to latch B. Latch B operates at a timing which follows the frequency of a signal INT which requires the execution of the timer interrupt routine. Signal INT is a stabilized signal usually has a frequency of about 40-odd KHz produced by division of a hard clock frequency. Thus, latch B outputs tone waveform data to D/A converter 6 at a predetermined sampling period depending on the frequency of the INT.

While the timer interrupt routine interrupts the main routine for executing purposes at predetermined intervals of time in accordance with the INT frequency, the timings at which the timer interrupt routine actually starts and ends can fluctuate. Even if the routine interrupts CPU 3, CPU 3 cannot immediately interrupt its operation under execution and after the execution, it performs a process for interruption. Since the time required for the timer interrupt process depends on that process, the period of tone production is unstable. Latch B controlled by the INT which is a correct timing signal is provided between latch A which is controlled by the COM signal and D/A converter 6. Thus, even if the latch timing for latch A fluctuates depending on the time required for the interrupt process, the timing at which the data input to D/A converter 6 is switched is synchronized with the INT due to the existence of latch B which operates at the INT timing. D/A converter 6 receives a signal which is delayed by one period of the INT at its timing and convents the signal to an analog musical tone waveform signal. The resulting voice waveform signal is filtered by low pass filter 7, amplified by amplifier 8, and then broadcasted through speaker 9.

Figure 21:
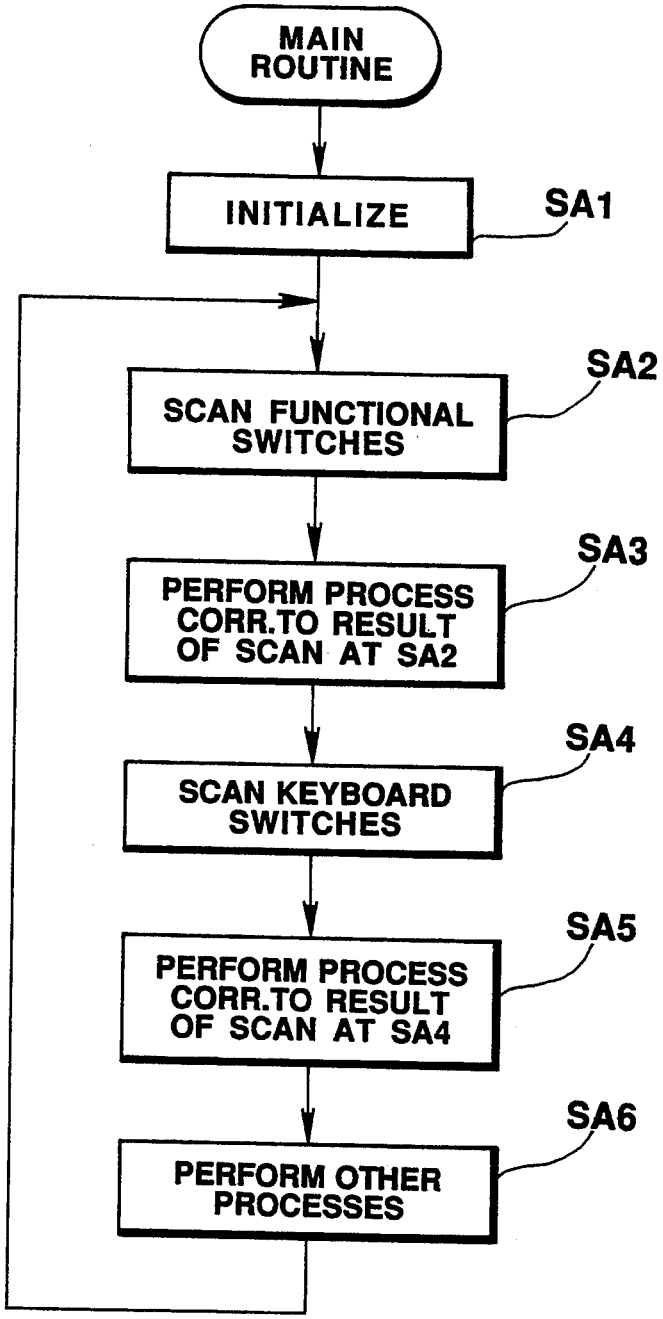
FIG. 21 is a flowchart indicative of a main routine for the fourth embodiment.

The operation of the present embodiment, thus constructed, will be described in accordance with a flowchart which outlines a program executed by CPU 3. FIG. 21 shows a main routine for the present embodiment. It is started by turning on the power source. First, initialization (SA1) clears the registers in RAM 5 and sets initial values in elements concerned. At this time, register F, A and B and 2-second counter, to be described later in more detail, are reset to 0. The functional switches except for the key board switches provided in the switch unit 1 are scanned (SA2). As a result, the functional switches which have changed their statuses are identified and the corresponding process is performed (SA3).

Subsequently, the keyboard switches provided in switch unit 1 are scanned (SA4). In response to the result of the scan, a corresponding process such as note-on or note-off is performed (SA5). Other processes except for the processes performed at SA3 and SA5 are performed (SA6), and the process SA2–SA6 is iterated as long as the power source is on.

Figure 20:
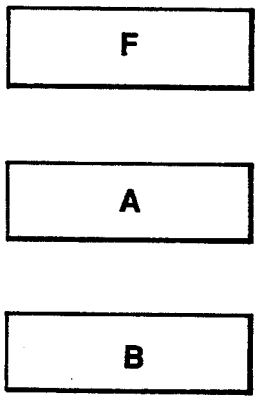
FIG. 20 illustrates some of registers provided in a RAM of the musical instrument involving the fourth embodiment.
Figure 22:
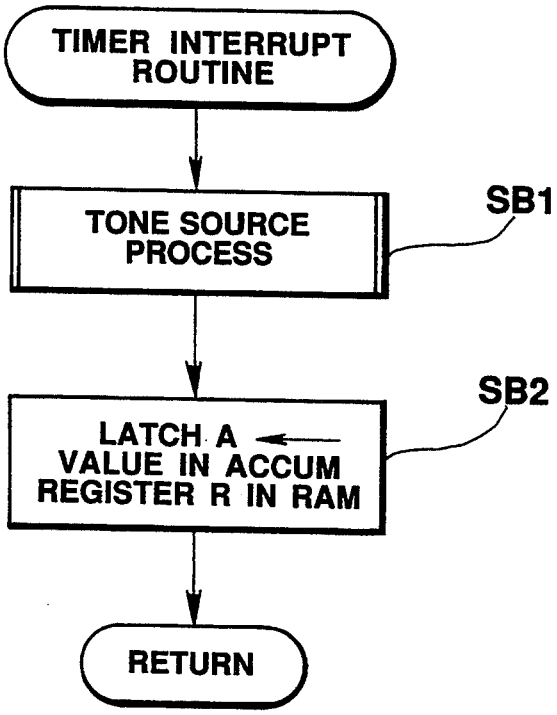
FIG. 22 is a flowchart indicative of a timer interrupt routine for the fourth embodiment.
Figure 23:
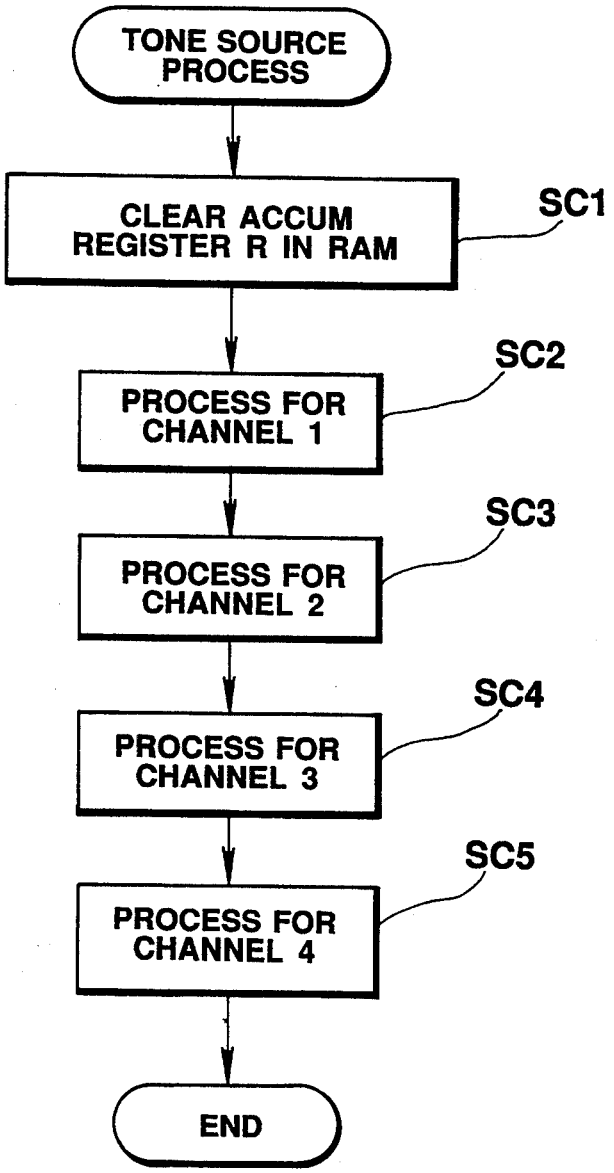
FIG. 23 is a flowchart indicative of the contents of a tone source process in the timer interrupt routine.

The timer interrupt routine of FIG. 22 interrupts the main routine at the above mentioned timing to perform the tone source process (SB1) in accordance with the flow of FIG. 23. First, accumulation register R provided in RAM 5 is cleared (SC1). Thus, the accumulated waveform value for channels 1–4 stored in the previous tone source process is erased, and then the tone source processes for all the channels 1–4 are sequentially performed (SC2–SC5). At SC2 the waveform value for channel 1 is calculated and set in accumulation register R. At SC 3 the waveform value for channel 2 is calculated similarly and added to the value in R. At SC4 and SC5, the waveform values for channels 3 and 4 are sequentially accumulated to the value in R accumulated at the last step. Thus, when the process at SC5 is completed, the accumulated waveform value for channels 1–4 is stored in R. The stored accumulated waveform value is latched by latch A at SB2 of FIG. 20. That is, the accumulated waveform value for channels 1–4 is latched by latch A at the timing when the tone source process (SB1) is completed. The accumulated waveform value latched by latch A is latched by latch B at a constant accurate sampling period produced by the division of the hard clock, as mentioned above, and converted by A/D converter 6 to an analog value, which is then broadcasted as a tone without distortion from speaker 9.

Figure 19:
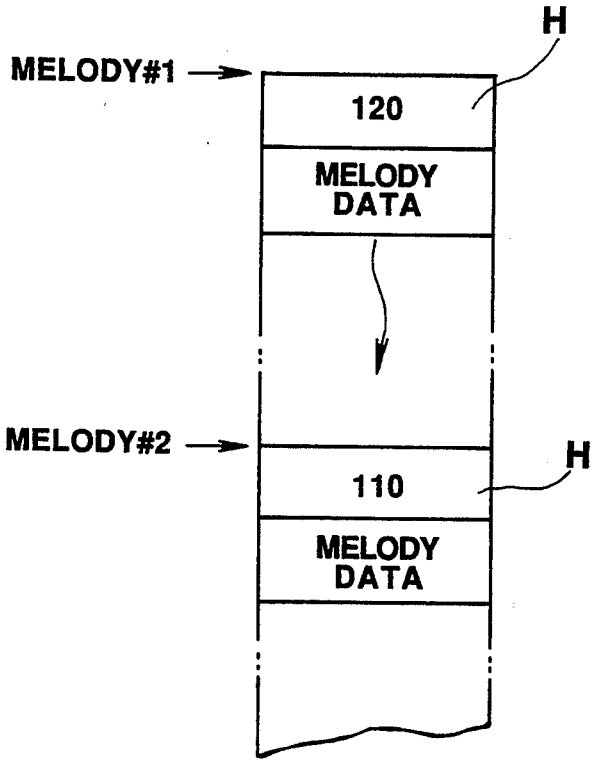
FIG. 19 illustrates a part of data on automatic performance stored in a ROM of the electronic musical instrument involving the fourth embodiment.
Figure 24:
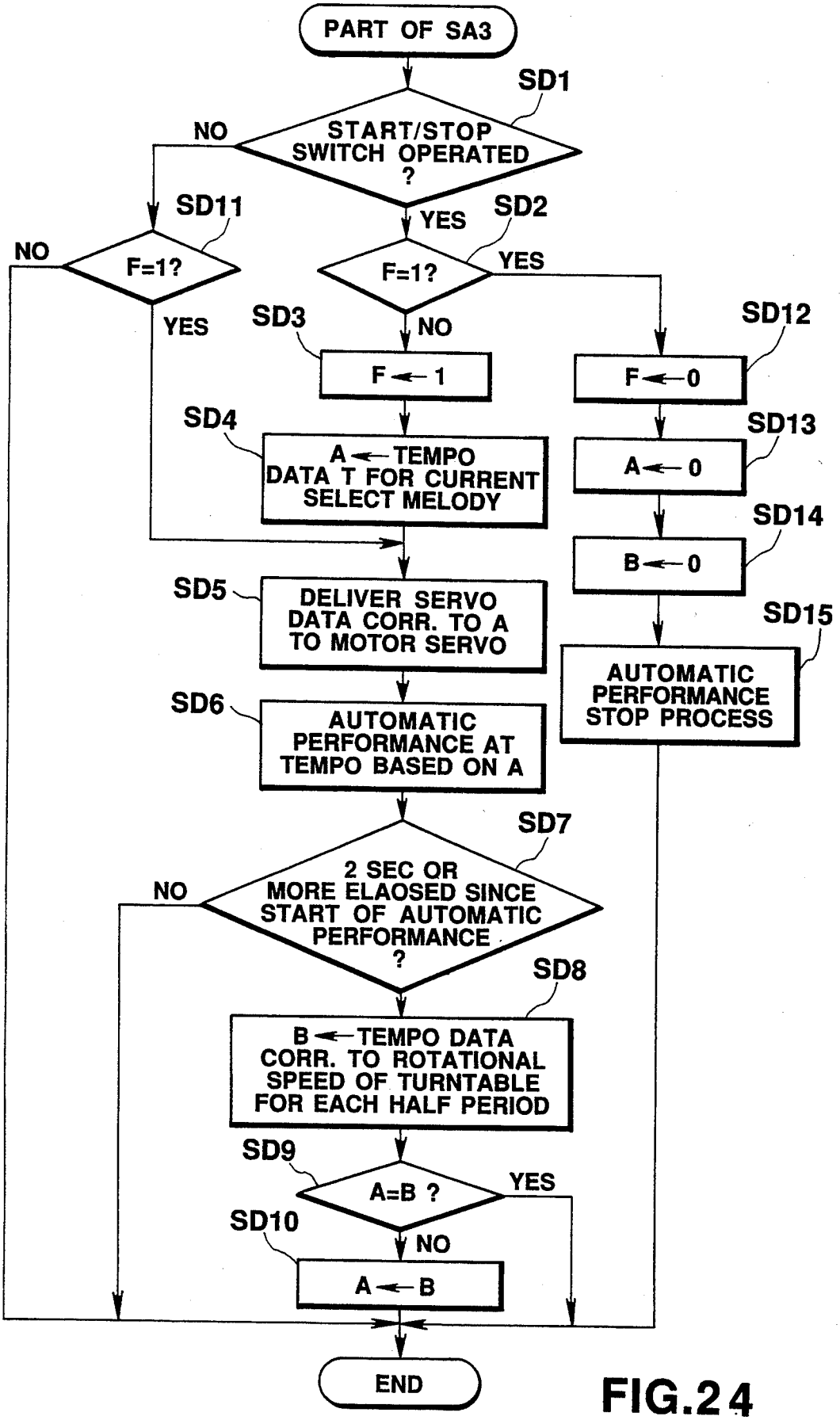
FIG. 24 is a flowchart indicative of a part of the SA3 process in the main routine of FIG. 19.

A part of SA3 of FIG. 19 is executed in accordance with the flow of FIG. 24. First, it is determined whether start/stop switch 13 is operated (SD1). If so, it is determined whether register F indicative of that automatic performance is being given is set (SD2). If register F is in a reset state and automatic performance is at a stop, register F is set (SD3). In addition, data on the tempo of the current melody beforehand selected by operating melody select switch 12 is loaded on register A (SD4). The data on the tempo loaded on register A is converted to corresponding servo data which is data on the rotational speed of motor 15 in accordance with a conversion table prepared beforehand in ROM 4 and the converted servo data is delivered to motor servo 21 (SD5).

Thus, motor servo 21 applies to motor 15 a voltage corresponding to the servo data to start the rotation of turntable 14 in conformity to the rotation of motor 15 so as to have a speed corresponding to the data on the tempo of the current selected melody. Subsequently, the automatic performance is given at the tempo data stored in register A (SD6). By this execution of the automatic performance, melody data is sequentially read out. The tone source process is executed using the melody data sequentially read out, speaker 9 broadcasts a melody composed of melody data at the tempo based on the tempo data.

Subsequently, it is determined on the basis of the value in 2-second counter which counts a lapse of 2 seconds since the start of the automatic performance whether 2 seconds have elapsed since that time (SD7). When 2 seconds have elapsed, the process and determination at SD8 sqq. start. Therefore, the process and determination at SD8 sqq. are not performed until 2 seconds have elapsed since the start of the automatic performance. The rotational speed of turntable during that interval of time increases to a speed corresponding to the tempo data. When two seconds have elapsed, data on the tempo corresponding to the speed of turntable 14 for each half period is stored in register B at SD8.

Light receipt element **17*b* or 18*b* is put in a low level state where it detects no reflected light from lower surface 14*a* of turntable 14 each time black mark 16 passes over light receipt element 17*b* or 18*b* because the black mark absorbs light from the corresponding adjacent light emission element 17*a* or 18*a*. The positional relationship between both light receipt elements 17*a* and 18*a* that they are 180 degrees out of phase from each other, so that the rotational speed of turntable 14 is detected by using the interval of time from the time when one of light receipt elements 17*a* and 18*a* comes at low level to the time when the other of light receipt elements 17*a* and 18*a* comes at low level. The data on the rotational speed is converted to the corresponding tempo data by a conversion table prepared beforehand in ROM 4** and the tempo data is stored in register B.

It is determined at step SD9 whether the value of the tempo data stored in register B at step SD8 is equal to the value of the tempo data stored beforehand in register A. If $A=B$ at this determination, turntable 14 is in a state where it performs a uniform speed rotation without receiving any external operating force. In contrast, if for example, an operating force is applied to turntable 14 in its rotational direction, turntable 14 is accelerated, so that $A<B$ because tempo data having a value larger than that in register A is set in register B at step SD8. If an operating force is applied to the turntable in the reverse direction, turntable 14 is decelerated, so that $A>B$ because tempo data having a value smaller than that in register A is set in register B at SD8. Therefore, in these cases, control passes from SD9 to SD10, where the tempo data set in register B beforehand at SD8 is set in register A (SD10).

If start/stop switch 13 is not operated, control passes from SD1 to SD11, where it is determined whether register F is in a set state or not. If automatic performance is under execution, register F is in a set state, so that control passes from SD11 to SD5, where steps and determinations, starting with SD5 are iterated. If there is a change in the rotational speed of turntable 14, as mentioned above, the tempo data in register B has been set in register A by the process at SD10. Therefore, if servo data corresponding to the tempo data in register A at step SD5 is input to motor servo 21, motor 15 drives turntable 14 at a speed accelerated or decelerated by the application of the operating force to the turntable. Subsequently, if SD6 is executed, the automatic performance changes to a tempo which corresponds to the speed of turntable 14 controlled at SD5.

That is, when the rotational speed of turntable 14 is changed by the external operating force, turntable 14 then continues to rotate at the changed rotational speed while the tempo of the automatic performance changes in correspondence to the changed rotational speed of turntable 14. Thus, the user can visually and acoustically grip the tempo of the automatic performance changed by his operation by listening to the automatic performance while viewing a change in the speed of turntable 14 due to the external operation. As a result, even a beginner which has no sense of musical tempo can clearly grip a change in the tempo of the automatic performance by the synergism of stimuli to visual and acoustic senses.

When control passes from SD1 to SD2 by operating start/stop switch 13 again, register F is in a set state in automatic performance, so that control passes to SD12, where register F is reset and registers A and B are sequentially reset to 0 (SD13, SD14) and a process for stopping the automatic performance is performed (SD5). In this process, the various registers and counters, for example, the 2-second counter used at step SD7, used in the automatic performance, except for the registers illustrated at SD12–SD14 are initialized.

While in the fourth embodiment the operation of start/stop switch 13 when the automatic performance is at a stop causes automatic performance and the rotation of turntable 14 to start, automatic performance and the rotation of turntable 14 may be started under the conditions where an operating forces is applied to turntable 14 when automatic performance is at a stop.

What is claimed is:

1. An automatic performance apparatus comprising:

operated rotation means which is operable by a user for rotating purposes;

operated state detecting means for detecting whether the user is operating said operated rotation means;

rotational speed detecting means for detecting the rotational speed of said operated rotation means;

clock output means for outputting a clock signal having a frequency corresponding to the rotational speed detected by said rotational speed detecting means;

automatic performance data storage means for storing data on an automatic performance; and automatic performance control means for giving an automatic performance while controlling a timing at which the data on the automatic performance is read out from said data storage means in units of a time corresponding to the frequency of the clock signal.

2. An automatic performance apparatus according to claim 1, wherein:

said operated rotation means includes generation means for generating a pulse signal having a predetermined frequency; and said rotational speed detecting means comprises a detector for detecting the pulse signal from said generation means of said operated rotation means, a waveform shaper for shaping the waveform of the pulse signal detected by said detector; a frequency-to-voltage converter for converting the pulse signal from said waveform shaper to a voltage signal corresponding to the frequency of the pulse signal; and a sample and hold circuit for sampling and holding the voltage signal in accordance with a predetermined sample clock signal at a timing when the result of the detection by said operated state detecting means is affirmative, whereby the rotational speed of said operated rotation means is detected as a voltage signal output from said sample and hold circuit.

3. An automatic performance apparatus according to claim 1, wherein:

said operated rotation means includes generation means for generating a pulse signal having a predetermined frequency; and said rotational speed detecting means comprises a detector for detecting the pulse signal from said generation means of said operated rotation means, a waveform shaper for shaping the waveform of the pulse signal detected by said detector; a pulse interval counter for calculating a digital value indicative of an inverse of the interval between any adjacent pulses of the pulse signal output from said waveform shaper; and a latch for latching the digital value output from said pulse interval counter in accordance with a predetermined latch clock signal at a timing when the result of the detection by said operated state detecting means is affirmative, whereby the rotational speed of said operated rotation means is detected as a voltage signal output from said latch.

4. An automatic performance apparatus comprising:

operated rotation means which is operable by a user;

operated state detecting means for detecting whether the user is operating said operated rotation means;

rotational speed detecting means for detecting the rotational speed of said rotation means;

rotational direction detecting means for detecting the rotational direction of said rotation means;

drive means for driving said operated rotation means such that when the result of the detection by said operated state detecting means becomes affirmative most recently, said rotation means has a rotational speed which said rotational speed detecting means has detected and a rotational direction which said rotational direction detecting means has detected;

clock output means for outputting a clock signal having a frequency corresponding to the rotational speed which said rotational speed detecting means has detected;

rotational direction signal output means for outputting a rotational direction signal corresponding to the rotational direction of said operated rotation means which said rotational direction detecting means has detected;

automatic performance data storage means for sequentially storing at successive addresses sets of event data and time data for control of a timing of reading out the event data for an automatic performance; and automatic performance control means for controlling on the basis of the rotational direction signal the direction of designating an address at which each set of event data and time data is read out from said automatic performance data storage means, for reading that event data while controlling the timing of reading that set of event data and time data by determining the time data in units of a time corresponding to the frequency of the clock signal, and for causing a musical instrument to give an automatic performance on the basis of that event data.

5. An automatic performance apparatus according to claim 4, wherein when said automatic performance control means designates a direction corresponding to that of a usual performance as the direction of designating the address at which that set of event data and time data is read out in said automatic performance data storage means, said automatic performance control means controls the instrument on the basis of the designation of the start or end of generation of a tone based on that event data read out of said automatic performance data storage means while when said automatic performance control means designates a direction corresponding to the direction of performance reverse to the direction of the usual performance as the direction of designating the address, said automatic performance control means converts the designation of each of the start and end of generation of a tone based on the event data read out of said automatic performance data storage means to the designation of each of the end and start of generation of that tone, and then controlling the instrument on the basis of the converted designation.

6. An automatic performance apparatus according to claim 4, wherein:

said automatic performance data storage means stores tempo data for setting a starting tempo of an automatic performance; and said automatic performance control means further comprises initial tempo setting means for reading tempo data out of said automatic performance data storage means when said rotation means starts to be used, and for determining the rotational speed of said rotation means when said rotation means starts to be used on the basis of the read out tempo data.

7. An automatic performance apparatus according to claim 4, wherein:

said operated rotation means includes generation means for generating a pulse signal having a predetermined frequency; and said rotational speed detecting means comprises a detector for detecting the pulse signal from said generation means of said operated rotation means; a waveform shaper for shaping the waveform of the pulse signal detected by said detector; a frequency-to-voltage converter for converting the pulse signal from said waveform shaper to a voltage signal corresponding to the frequency of the pulse signal; and a sample and hold circuit for sampling and holding the voltage signal in accordance with a predetermined sample clock signal at a timing when the result of the detection by said operated state detecting means is affirmative, whereby the rotational speed of said operated rotation means is detected as a voltage signal output from said sample and hold circuit.

8. An automatic performance apparatus according to claim 4, wherein:

said operated rotation means includes generation means for generating a pulse signal having a predetermined frequency; and said rotational speed detecting means comprises a detector for detecting the pulse signal from said generation means of said operated rotation means; a waveform shaper for shaping the waveform of the pulse signal detected by said detector; a pulse interval counter for calculating a digital value indicative of the inverse of the interval between any adjacent pulses of the pulse signal output from said waveform shaper; and a latch for latching the digital value output from said pulse interval counter in accordance with a predetermined latch clock signal at a timing when the result of the detection by said operated state detecting means is affirmative, whereby the rotational speed of said operated rotation means is detected as a voltage signal output from said latch.

9. An automatic performance apparatus comprising:

operated means which is operable by a user;

an operation change quantity detecting means for detecting an operation change quantity of said operated means;

accumulating means for accumulating the operation change quantity;

clock output means for outputting a clock signal having a frequency corresponding to an absolute value of an accumulated value output from said accumulating means;

direction signal output means for outputting as a direction signal a signal indicative of a sign of the accumulated value output from said accumulating means;

display means including a plurality of light emitting elements for causing said light emitting elements to sequentially emit light at a rate corresponding to the absolute value of the accumulated value output from said accumulating means in a direction corresponding to the sign of the accumulated value;

automatic performance data storage means for storing data on automatic performance; and automatic performance control means for giving an automatic performance while controlling the timing of reading data on automatic performance in units of a time corresponding to the frequency of the clock signal.

10. An automatic performance apparatus comprising:

operated means which is operable by a user;

an operation change quantity detecting means for detecting an operation change quantity of said operated means;

accumulating means having a predetermined initial value as an accumulated value when said accumulating means is used for accumulating the operation change quantity;

clock output means for outputting a clock signal having a frequency corresponding to an absolute value of an accumulated value output from said accumulating means;

direction signal output means for outputting as a direction signal a signal indicative of a sign of the accumulated value output from said accumulating means;

display means including a plurality of light emitting elements for causing said light emitting elements to sequentially emit light at a rate corresponding to the absolute value of the accumulated value output from said accumulating means in a direction corresponding to the sign of the accumulated value;

automatic performance data storage means for sequentially storing at successive addresses set of event data and time data for control of a timing of reading out the event data for automatic performance; and automatic performance control means for controlling, on the basis of the rotational direction signal, the direction of designating an address at which each set of event data and time data is read out from said automatic performance data storage means, for reading that event data while controlling the timing of reading that set of event data and time data by determining the time data in units of a time corresponding to the frequency of the clock signal, and for causing a musical instrument to give an automatic performance on the basis of that event data.

11. An automatic performance apparatus according to claim 10, wherein when said automatic performance control means designates a direction corresponding to that of a usual performance as the direction of designating the address at which that set of event data and time data is read out from said automatic performance data storage means, said automatic performance control means controls the instrument on the basis of the designation of the start or end of generation of a tone based on that event data read out of said automatic performance data storage means, while when said automatic performance control means designates a direction corresponding to the direction of performance reverse to the direction of the usual performance as the direction of designating the address, said automatic performance control means converts the designation of each of the start and end of generation of a tone based on the event data read out of said automatic performance data storage means to the designation of each of the end and start of generation of that tone, and then controlling the instrument on the basis of the converted designation.

12. An automatic performance apparatus according to claim 10, wherein:

said automatic performance data storage means stores tempo data for setting a starting tempo of automatic performance; and said device further comprises initial tempo setting means for reading tempo data out of said automatic performance data storage means when said rotation means starts to be used and for determining the predetermined initial value of said accumulating means when said accumulating means starts to be used on the basis of the read out tempo data.

13. An automatic performance apparatus according to claim 10, wherein:

said operated means comprises a rotary encoder to which a rotation member operable by the user is connected;

said operation change quantity detecting means comprises a touch detector for detecting whether the user is operating said rotation member by determining whether a pulse signal from said rotary encoder has been detected, and a pulse counter for counting the number of pulses of the pulse signal output from said rotary encoder at predetermined intervals of time when the result of the detection by said touch detector is affirmative, said operation change quantity detecting means detecting the output from said pulse counter as the operation change quantity;

said automatic performance apparatus further comprising a rotational direction detector for detecting the rotational direction of said rotary encoder; and said accumulating means comprises an accumulating unit for adding the output from said pulse counter to the last accumulated value at predetermined intervals of time when the output from said rotational direction detector indicates a forward rotation and for subtracting the output from said pulse counter from the last accumulated value at predetermined intervals of time when the output from said rotational direction detector indicates a reverse rotation.

* * * * *